US005691712A

United States Patent [19]

Meek et al.

[11] Patent Number: 5,691,712

[45] Date of Patent: Nov. 25, 1997

[54] MULTIPLE WELLBORE TOOL APPARATUS INCLUDING A PLURALITY OF MICROPROCESSOR IMPLEMENTED WELLBORE TOOLS FOR OPERATING A CORRESPONDING PLURALITY OF INCLUDED WELLBORE TOOLS AND ACOUSTIC TRANSDUCERS IN RESPONSE TO STIMULUS SIGNALS AND ACOUSTIC SIGNALS

[75] Inventors: Dale E. Meek; Vladimir Vaynshteyn, both of Sugarland, Tex.

[73] Assignee: Schlumberger Technology Corporation, Houston, Tex.

[21] Appl. No.: 506,637

[22] Filed: Jul. 25, 1995

[51] Int. Cl.[6] ..... G01V 1/40; E21B 34/08

[52] U.S. Cl. ..... 340/853.3; 340/853.1; 340/855.5; 340/854.3; 166/65.1; 166/250

[58] Field of Search ..... 166/65.1, 250; 340/853.1, 853.2, 853.3, 853.9, 854.3, 855.5, 855.6; 367/81, 83

[56] References Cited

U.S. PATENT DOCUMENTS

| | | | |
|---|---|---|---|
| 3,233,674 | 2/1966 | Leutwyler . | |
| 3,971,317 | 7/1976 | Gemmell et al. . | |
| 4,078,620 | 3/1978 | Westlake et al. . | |
| 4,355,310 | 10/1982 | Belaiges et al. | 340/853.2 |
| 4,648,471 | 3/1987 | Bordon | 166/65.1 |
| 4,718,011 | 1/1988 | Patterson, Jr. | 364/422 |
| 4,796,699 | 1/1989 | Upchurch . | |
| 4,856,595 | 8/1989 | Upchurch . | |
| 4,886,126 | 12/1989 | Yates, Jr. . | |
| 4,896,722 | 1/1990 | Upchurch . | |
| 4,915,168 | 4/1990 | Upchurch . | |
| 4,971,160 | 11/1990 | Upchurch . | |

(List continued on next page.)

OTHER PUBLICATIONS

Brochure, "What's new From the Leader in Completion Technology—EAS EAS Downhole Tool Actuation and Control System" 1991.

*Primary Examiner*—Ian J. Lobo

*Attorney, Agent, or Firm*—Gordon G. Waggett; John H. Bouchard; John J. Ryberg

[57] ABSTRACT

A multiple wellbore tool apparatus consisting of a plurality of microprocessor implemented wellbore tools is disposed in a fluid filled wellbore, and an input stimulus having a predetermined signature propagates down the wellbore fluid to all of the wellbore tools. The plurality of wellbore tools each include a microprocessor implemented controller board as well as an included wellbore tool and an acoustic receiver transmitter transducer connected to an output of the controller board. In addition, each of the microprocessors of each controller board include a memory which stores its own unique microcode programming. In response to the input stimulus, the controller board of a first wellbore tool determines that a correspondence exists between the signature of the stimulus and information stored therein and generates an output signal. The output signal may operate an included wellbore tool, or, in response to the output signal, the acoustic transmitter may transmit a first acoustic signal either through an outer housing of the multiple wellbore tool apparatus, or through the wellbore fluid, to all of the other wellbore tools. In response to the first acoustic signal, the controller board of a second wellbore tool will operate its included wellbore tool. When its operation is complete, that included wellbore tool will transmit a signature confirmation signal back to its controller board indicative of completion of its operation. That controller board will respond By instructing its acoustic transmitter to propagate a second acoustic signal through the outer housing or the wellbore fluid. A controller board of a third wellbore tool will respond to the second acoustic signal by operating its included wellbore tool. The above operational sequence is repeated until all of the included wellbore tools of the plurality of wellbore tools of the multiple wellbore tool apparatus are automatically operated in a pre-programmed manner as defined by the microcode programming encoded in the plurality of microprocessors.

46 Claims, 17 Drawing Sheets

U.S. PATENT DOCUMENTS 5,036,945 8/1991 Hoyle et al. .
5,050,675 9/1991 Upchurch .
5,050,681 9/1991 Skinner .
5,174,161 12/1992 Veneruso et al. .
5,273,113 12/1993 Schultz ..... 166/250
5,279,363 1/1994 Schultz et al. .
5,293,937 3/1994 Schultz et al. .
5,316,087 5/1994 Manke et al. .

MULTIPLE WELLBORE TOOL APPARATUS INCLUDING A PLURALITY OF MICROPROCESSOR IMPLEMENTED WELLBORE TOOLS FOR OPERATING A CORRESPONDING PLURALITY OF INCLUDED WELLBORE TOOLS AND ACOUSTIC TRANSDUCERS IN RESPONSE TO STIMULUS SIGNALS AND ACOUSTIC SIGNALS

BACKGROUND OF THE INVENTION

The subject matter of the present invention relates to a multiple wellbore tool apparatus adapted to be disposed in a fluid filled wellbore, and in particular, to a multiple wellbore tool apparatus including a plurality of wellbore tools, where each of the plurality of wellbore tools include an input stimulus sensor adapted for sensing an input stimulus propagating in the wellbore fluid, an included wellbore tool, such as a packer or a valve, an acoustic receiver transmitter transducer adapted for transmitting acoustic signals into and receiving acoustic signals from either the wellbore fluid or an outer housing, and a microprocessor implemented controller, connected between the input stimulus sensor, the acoustic receiver transmitter transducer, and the included wellbore tool, for receiving a particular input stimulus from the sensor in response to a corresponding input stimulus received in the sensor from the wellbore fluid, attempting to translate the particular input stimulus into either an instruction signal or a signature signal, operating, responsive to the instruction signal, the included wellbore tool of the wellbore tool, and/or transmitting, responsive to the signature signal, an acoustic signal to another wellbore tool of the multiple wellbore tool apparatus, via the acoustic transducer and either the wellbore fluid or the outer housing, for the purpose of operating the included wellbore tool of said another wellbore tool.

Recent innovations in well tool control systems involve the use of a microprocessor disposed in a well tool for controlling the operation of the well tool. For example, the following U.S. Patents to James M. Upchurch, assigned to the same assignee as that of the present invention, involve the use of a microprocessor for operating one or more systems in a wellbore tool: U.S. Pat. Nos. 4,796,699 and 4,856,595 entitled "Well Tool Control System and Method"; U.S. Pat. No. 4,915,168 entitled "Multiple Well Tool Control Systems in a Multi-valve Well Testing System"; U.S. Pat. No. 4,896,722 entitled "Multiple Well Tool Control Systems in a Multi-Valve Well Testing System Having Automatic Control Modes"; and U.S. Pat. Nos. 4,971,160 and 5,050,675 entitled "Perforating and Testing Apparatus including a Microprocessor Implemented Control System Responsive to an Output From an Inductive Coupler or Other Input Stimulus". In addition, U.S. Pat. No. 4,886,126 to Yates, Jr. involves the use of a microprocessor for firing a perforating gun in response to only a single predetermined tubing pressure; and U.S. Pat. No. 5,050,681 to Skinner involves the use a microprocessor for operating a control apparatus which ultimately operates a bypass apparatus for bypassing changes in well annulus pressure around a reference pressure apparatus. In addition, in a brochure having a 1992 copyright date, Baker Oil Tools introduced a system known as the EAS Downhole Tool Actuation and Control System. The EAS system combines two downhole tool operating methods, electric wireline setting tools and hydraulics, and incorporates computer technology to provide a means of actuating downhole tools, such as packers, by pressurizing the tubing string.

However, sophisticated systems which are adapted for use in a wellbore apparatus and involving the use of microprocessor technology, have not yet been fully developed.

For example, none of the prior art innovations discussed above disclose a multiple wellbore tool apparatus adapted to be disposed in a fluid filled. wellbore where each wellbore tool of the multiple wellbore tool apparatus includes a microprocessor implemented controller board interconnected between an input stimulus command sensor, an acoustic receiver transmitter transducer, and an included tool, where the controller board is adapted for storing information, receiving an input stimulus having a predetermined signature from the command sensor, comparing the signature of the stimulus with the information stored in the controller board, and generating an output signal when the signature corresponds to the stored information, where the output signal either operates the included tool or energizes the acoustic receiver transmitter, and where the acoustic transmitter transmits an acoustic signal via either the wellbore fluid or an outer housing of the multiple wellbore tool apparatus to all the other wellbore tools of the multiple wellbore tool apparatus for interrogating the controller board in all the other wellbore tools and operating the included tool in one or more of the other wellbore tools of the multiple wellbore tool apparatus.

Such sophisticated systems would be extremely valuable for efficiently operating a multitude of wellbore tools downhole and efficiently performing a multitude of wellbore operations in a wellbore in a predetermined sequence and in a predetermined manner, such as setting a packer, opening and closing a valve, enabling a recorder, and/or shooting a perforating gun.

SUMMARY OF THE INVENTION

Accordingly, it is a primary object of the present invention to provide a multiple wellbore tool apparatus adapted to be disposed in a fluid filled wellbore comprising a plurality of wellbore tools and including a plurality of microprocessor implemented controller boards disposed, respectively, in the plurality of wellbore tools.

It is a further object of the present invention to provide a multiple wellbore tool apparatus adapted to be disposed in a fluid filled wellbore comprising a plurality of wellbore tools and including a plurality of microprocessor implemented controller boards disposed, respectively, in the plurality of wellbore tools, a plurality of command sensors connected, respectively, to an input of the plurality of controller boards, a plurality of acoustic receiver transmitter transducers connected, respectively, to an output of the plurality of controller boards, and a plurality of included wellbore tools connected, respectively, to an output of the plurality of controller boards.

It is a further object of the present invention to provide a multiple wellbore tool apparatus adapted to be disposed in a fluid filled wellbore comprising a plurality of wellbore tools and including a plurality of microprocessor implemented controller boards disposed, respectively, in the plurality of wellbore tools, a plurality of command sensors connected, respectively, to an input of the plurality of controller boards, a plurality of acoustic receiver transmitter transducers connected, respectively, to an output of the plurality of controller boards, and a plurality of included wellbore tools connected, respectively, to an output of the plurality of controller boards, where a controller board receives a stimulus from the wellbore fluid via a command sensor, generates an output signal when the stimulus corresponds to information stored in the controller board, and either operates an included wellbore tool in response to the output signal or transmits an acoustic signal from an acoustic transmitter in response to the output signal, the acoustic signal being transmitted from the acoustic transmitter via either the wellbore fluid or an outer housing of the multiple wellbore tool apparatus to another controller board of another wellbore tool for operating the included wellbore tool of the other wellbore tool.

In accordance with these and other objects of the present invention, a multiple wellbore tool apparatus is adapted to be disposed in a fluid filled wellbore and includes a plurality of wellbore tools, a plurality of microprocessor implemented controller boards disposed, respectively, in the plurality of wellbore tools, a plurality of command sensors adapted for receiving an input stimulus propagating in the wellbore fluid connected, respectively, to the inputs of the plurality of controller boards of the plurality of wellbore tools, a plurality of included wellbore tools connected, respectively, to the outputs of the plurality of controller boards, and a plurality of acoustic receiver transmitter transducers (each being hereinafter called an "acoustic R/T") connected, respectively, to the outputs of the plurality of controller boards.

In operation, an input stimulus, usually in the form of one or more pressure pulses having a first predetermined signature, is propagated down the wellbore fluid from a surface of the wellbore. The input stimulus is received in the plurality of command sensors of the plurality of wellbore tools of the multiple wellbore tool apparatus. The plurality of controller boards in the plurality of wellbore tools will each compare the first signature of the input stimulus received in the plurality of command sensors with address information stored therein. Address information is stored in a memory of each of the controller boards in the form of microcode.

The first signature of the input stimulus received from the wellbore fluid is received in a command sensor of a first wellbore tool. Recall that the first wellbore tool includes a first controller board. The command sensor generates an output signal representative of the first signature. Assume that the first signature of the output signal from the command sensor will correspond to address information stored in a memory of the first controller board. As a result, the first controller board of the first wellbore tool will generate an output signal which comprises either an instruction signal or a signature signal having a second signature. The instruction signal from the first controller board is directed to the included wellbore tool of the first wellbore tool; however, the signature signal from the first controller board is directed to the acoustic R/T of the first wellbore tool. If the instruction signal is directed to the included wellbore tool, the included wellbore tool will be operated. On the other hand, if the signature signal, having the second signature, is directed to the acoustic R/T of the first wellbore tool, the acoustic R/T of the first wellbore tool will respond by transmitting a first acoustic signal, having the second signature, into either the wellbore fluid or into the outer housing of the multiple wellbore tool apparatus.

The first acoustic signal from either the wellbore fluid or the outer housing will be picked up by the acoustic R/T's of all of the other wellbore tools of the multiple wellbore tool apparatus. In response thereto, the acoustic R/T's of all of the other wellbore tools will generate an electrical output signal also representative of the second signature. The controller boards associated with all of the other wellbore tools will compare the second signature of the electrical output signal from the acoustic R/Ts with address information stored therein in its memory.

In response thereto, assume that a second controller board associated with a second wellbore tool of the multiple wellbore tool apparatus will generate an instruction signal when the second signature of the electrical output signal from the acoustic R/Ts corresponds with address information stored in the memory of the second controller board. The instruction signal from the second controller board will operate a second included wellbore tool that is connected to the second controller board. When the second included wellbore tool is operated, the included wellbore tool will generate its own signature confirmation signal indicative of completion of its operation. The second included wellbore tool's signature confirmation signal bears its own third predetermined signature. The third signature of the signature confirmation signal from the second included wellbore tool will be compared, in the second controller board, with address information stored therein, and the second controller board will generate a signature instruction signal having a fourth predetermined signature. The acoustic R/T connected to the second controller board will respond to the signature instruction having the fourth signature by transmitting an acoustic signal, bearing the fourth signature, into either the wellbore fluid or the outer housing of the multiple wellbore tool apparatus.

The acoustic signal bearing the fourth signature will be picked up by the acoustic R/T's of all of the other wellbore tools of the multiple wellbore tool apparatus. In response thereto, the acoustic R/T's of all of the other wellbore tools of the multiple wellbore tool apparatus will generate an electrical output signal having the fourth signature. The controller boards associated with all of the other wellbore tools will compare the fourth signature of the electrical output signals from their acoustic R/Ts with address information stored in their memory.

However, assume that a third controller board of a third wellbore tool will find that the fourth signature of the output signal from its acoustic R/T will correspond to address information stored in its memory. As a result, the third controller board will generate an instruction signal. The instruction signal from the third controller board will operate a third included wellbore tool connected to the third controller board. When the third included wellbore tool is operated, the third included wellbore tool will generate its own signature confirmation signal indicative of completion of its operation.

The above described process will repeat itself, over and over again, until all of the included wellbore tools of all of the wellbore tools of the multiple wellbore tool apparatus is operated. In fact, all of the included wellbore tools will be operated in a predetermined sequence and in a predetermined manner as instructed by a set of microcode instructions encoded in each of the memories of the plurality of microprocessor implemented controller boards of the plurality of wellbore tools of the multiple wellbore tool apparatus of the present invention.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein:

FIGS. 31A and 3lB illustrate an actual construction of the second part of the perforating gun wellbore tool shown in FIG. 23 which is adapted to be connected to the first part shown in FIG. 25.

DETAILED DESCRIPTION OF THE PREFERRED EMBODIMENT

Figure 1:
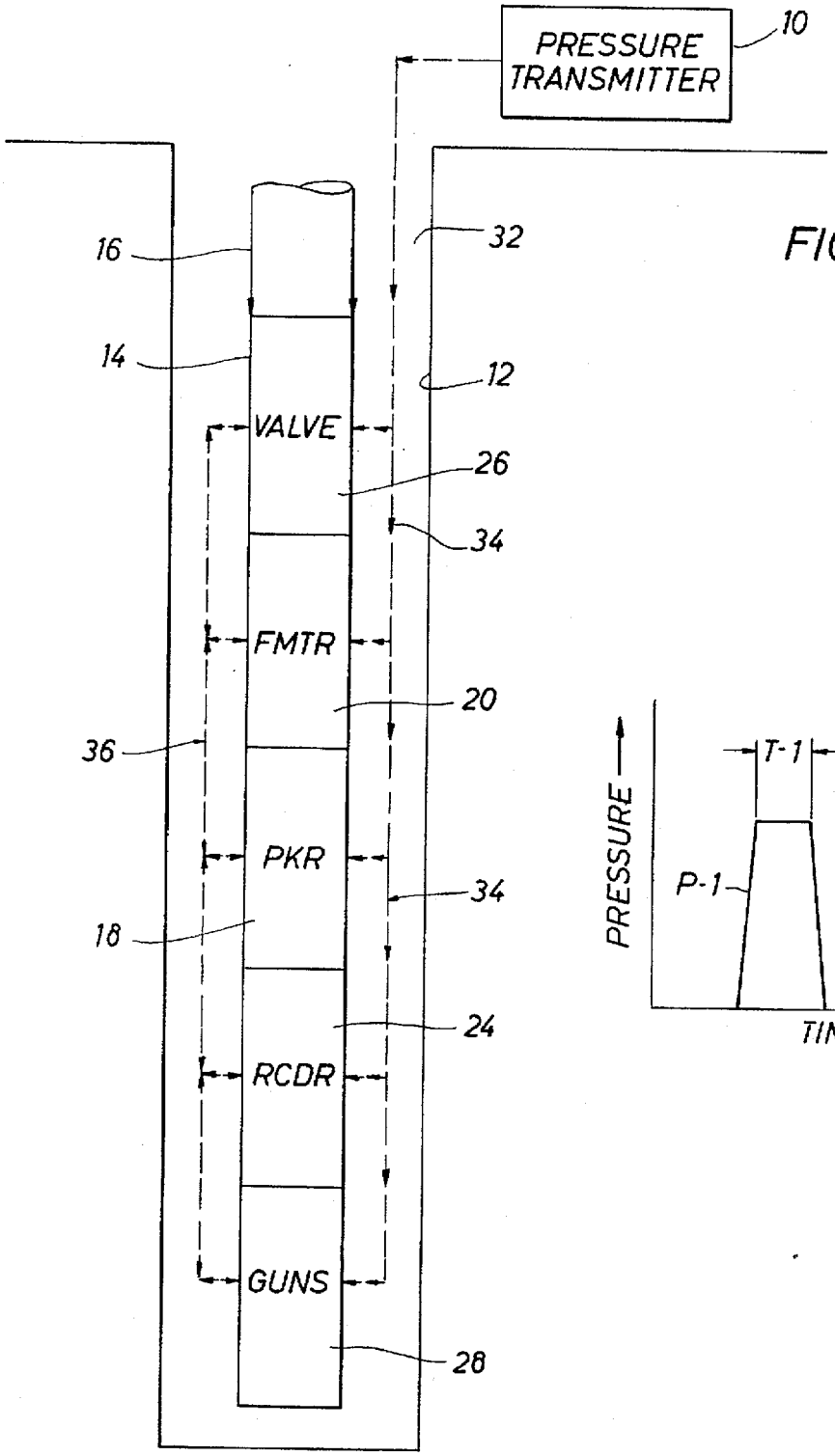
FIG. 1 illustrates a multiple wellbore tool apparatus in accordance with the present invention adapted to be disposed in a fluid filled wellbore comprising a plurality of wellbore tools including a valve, a flowmeter, a packer, a recorder, and a perforating gun.

Referring to FIG. 1, a multiple wellbore tool apparatus is shown disposed in a wellbore.

In FIG. 1, a pressure transmitter 10 is situated at a surface of a fluid filled wellbore 12. A multiple wellbore tool apparatus 14 suspends by a suspension apparatus 16 in the fluid filled wellbore 12. The suspension apparatus 16 may include either a wireline, a production tubing, or a coiled tubing. The multiple wellbore tool apparatus 14 includes: a test valve module (VALVE) 26, including a valve adapted for opening and closing, a flowmeter module (FMTR) 20 connected to the test valve module 26 adapted for measuring a flowrate of a formation fluid flowing within the interior of the multiple wellbore tool apparatus 14, a packer module (PKR) 18 adapted for sealing a casing which lines the wellbore 12, a recorder module (RCDR) 24 connected to the packer module 18 adapted for measuring a parameter of the formation fluid flowing within the multiple wellbore tool apparatus, such as pressure, and a perforating gun module (GUNS) 28 including one or more perforating guns 28 connected to the recorder module 24 adapted for perforating the formation penetrated by the wellbore 12 and initiating the flow of a formation fluid from the formation penetrated by wellbore 12, which formation fluid is initially received in a slotted tail pipe connected to the perforating gun 28 and flows within the interior of the multiple wellbore tool apparatus 14 of FIG. 1.

In FIG. 1, the pressure transmitter 10 transmits an input stimulus, including one or more pressure pulses, into an annulus region 32 located above the packer 18, the annulus region 32 being filled with wellbore fluid. The pressure pulse input stimulus propagates along a path of travel 34 to all of the plurality of wellbore tools 26, 20, 18, 24, and 28 which comprise the multiple wellbore tool apparatus 14 of the present invention. The path of travel 34 will hereinafter be known as "the input stimulus wellbore fluid data bus 34".

However, note that the input stimulus could consist of something other than pressure pulses. For example, the input stimulus could consist of electromagnetic signals or acoustic signals.

Figure 6:
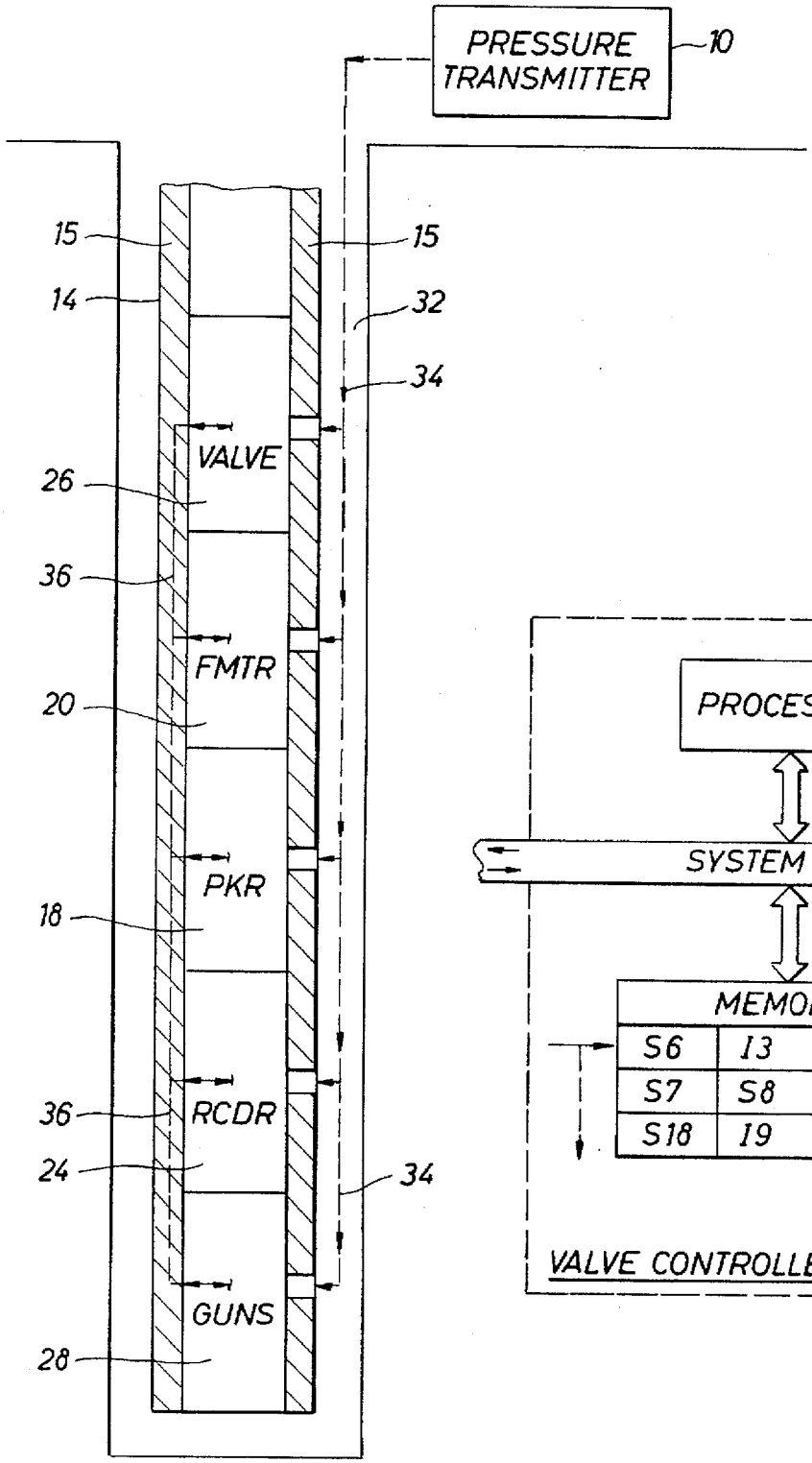
FIG. 6 illustrates the same multiple wellbore tool apparatus in accordance with the present invention as shown in FIG. 1; however, in FIG. 6, the multiple wellbore tool apparatus is enclosed by an outer housing; as a result, while the command sensors are responsive to the stimulus signals propagating down the wellbore fluid, the acoustic R/Ts are responsive to acoustic signals propagating in the outer housing of the multiple wellbore tool apparatus.

When the pressure pulse input stimulus is received from the input stimulus wellbore fluid data bus 34 and into the plurality of wellbore tools 26, 20, 18, 24, and 28 of the multiple wellbore tool apparatus 14 of FIG. 1, a first one of the wellbore tools may respond by operating its included wellbore tool, or it may respond by transmitting one or more acoustic signals from the first wellbore tool, into the wellbore fluid .situated external to the plurality of wellbore tools along a path of travel 36 (or along a path of travel 36 located within an outer housing 15 of the apparatus 14 of FIG. 6), and to all of the other wellbore tools of the multiple wellbore tool apparatus 14 of FIG. 1 for the purpose of operating one of the other included wellbore tools of one of the plurality of wellbore tools of the multiple wellbore tool apparatus. Recall that the plurality of wellbore tools of the multiple wellbore tool apparatus 14 include the valve module 26 whose included wellbore tool is a valve, the flowmeter module 20 whose included wellbore tool is a flowmeter sensor, the packer module 18 whose included wellbore tool is a packer, the recorder module 24 whose included wellbore tool is a pressure recorder sensor, and the perforating gun module 28 whose included wellbore tool is a perforating gun.

Since, in FIG. 1, the path of travel 36 is defined to be located within the wellbore fluid disposed external to the multiple wellbore tool apparatus 14, but, in FIG. 6, the path of travel 36 is defined to be located within an outer housing 15 of the multiple wellbore tool apparatus 14, the path of travel 36 will hereinafter be known as "the acoustic data bus 36".

Recall that a number of prior art patents already disclose the transmission of an input stimulus through a wellbore fluid of a fluid filled wellbore to a receiver in a wellbore tool situated downhole for the purpose of operating an apparatus connected to the receiver. These prior art patents include the following:

1. U.S. Pat. Nos. 4,796,699 and 4,856,595 entitled "Well Tool Control System and Method";
2. U.S. Pat. No. 4,915,168 entitled "Multiple Well Tool Control Systems in a Multi-valve Well Testing System";
3. U.S. Pat. 4,896,722 entitled "Multiple Well Tool Control Systems in a Multi-Valve Well Testing System Having Automatic Control Modes"; and
4. U.S. Pat. Nos. 4,971,160 and 5,050,675 entitled "Perforating and Testing Apparatus including a Microprocessor Implemented Control System Responsive to an Output From an Inductive Coupler or Other Input Stimulus".

However, in addition, a number of prior art patents also disclose the transmission of an acoustic or pressure signal downhole or uphole via the wellbore fluid. For example, consider the following:

1. U.S. Pat. No. 3,971,317 to Gemmell et al issued Jul. 27, 1976 discloses an acoustically triggered subsurface detonator apparatus where an acoustic signal propagates within the wellbore fluid between the surface of the wellbore and the subsurface apparatus. The subsurface apparatus includes a receiver detonator system which senses and receives the acoustic signal propagating in the well fluid and, in response thereto, a piezoelectric transducer converts the received acoustic signal into an electrical signal which operates an electric circuit in the subsurface apparatus.
2. U.S. Pat. No. 4,078,620 to Westlake et al issued Mar. 14, 1978 discloses a subsurface valve assembly disposed in a wellbore filled with wellbore fluid. The subsurface valve assembly receives a pressure signal propagating in the wellbore fluid and, in response thereto, causes the transmission of a second pressure signal uphole through the wellbore fluid representative of conditions existing in the wellbore.
3. U.S. Pat. No. 3,233,674 to Leutwyler discloses a liner hanging apparatus which is disposed in a subsurface well for effecting it's setting against a liner by means of an explosive charge. Initiation of the explosive charge is effected by transmitting a suitable acoustic signal down a wellbore through the well fluid to a decoder transducer of the apparatus. Detectors are provided to detect and decode the impinging acoustic signals. A first detector responds to a first frequency and a second detector responds to a second frequency, both of which must be present contemporaneously before the explosive charge is electrically actuated.
4. U.S. Pat. No. 5,036,945 to Hoyle et al, entitled "Sonic Well Tool Transmitter and Receiver Array including an Attenuation and Delay Apparatus" discloses a sonic well tool which includes a monopole transmitter and a receiver array for receiving sonic pressure wave signals from a surrounding formation penetrated by a borehole.

Figure 2:
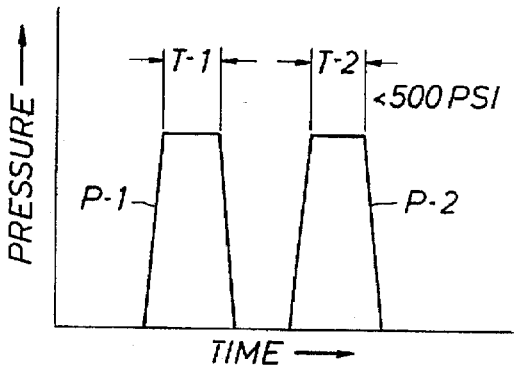
FIG. 2 illustrates one or more pressure pulses which can be transmitted down the wellbore fluid to the plurality of wellbore tools.

Referring to FIG. 2, an example of the one or more pressure pulse input stimuli transmitted downhole from the pressure transmitter 10 of FIG. 1 via the input stimulus wellbore fluid data bus 34 is illustrated. In FIG. 2, the pressure pulses transmitted downhole include two pulses, each having a unique pulse-width T-1 and T-2, each having a unique amplitude P-1 and P-2. However, although two pulses are shown, any number of pressure pulses may be transmitted downhole.

Figure 3:
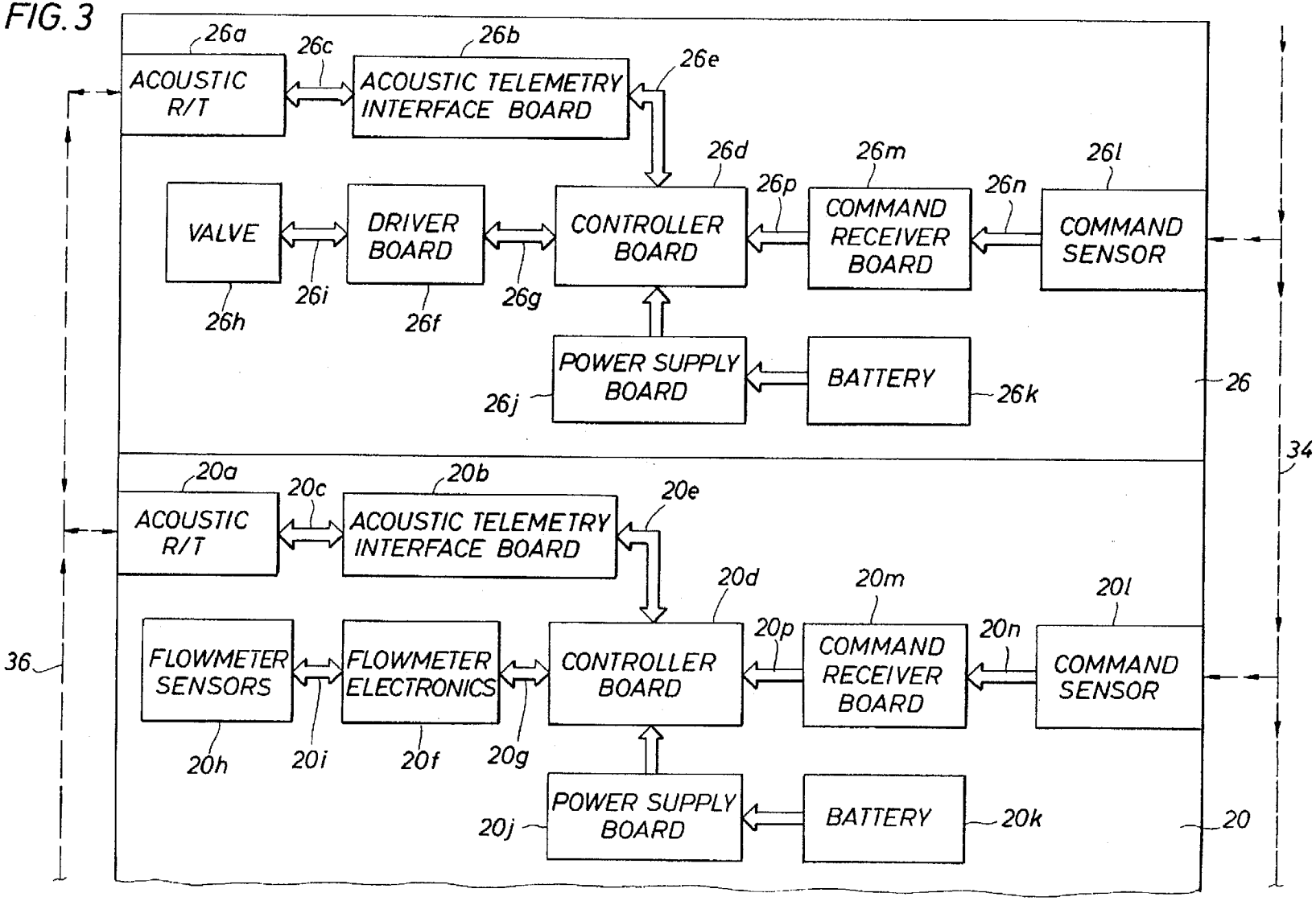
FIGS. 3, 4, and 5 illustrate a more detailed construction of each of the plurality of wellbore tools of the multiple wellbore tool apparatus of FIG. 1, each of the wellbore tools including a microprocessor implemented controller board interconnected between a command sensor that is responsive to stimulus signals propagating in down the wellbore fluid and an acoustic receiver transmitter transducer (acoustic R/T) that is responsive to acoustic signals propagating in the wellbore fluid.
Figure 4:
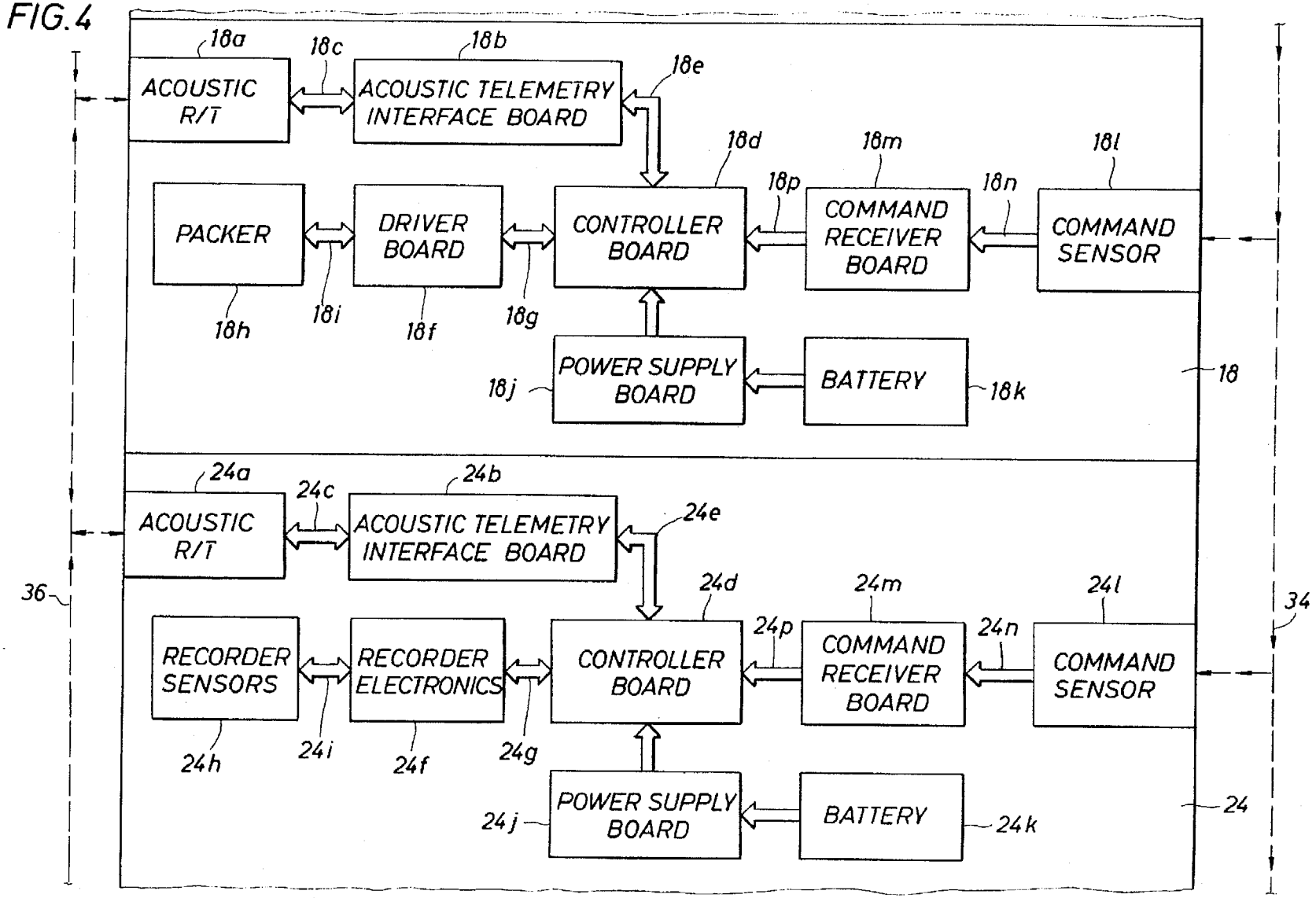
Figure 5:
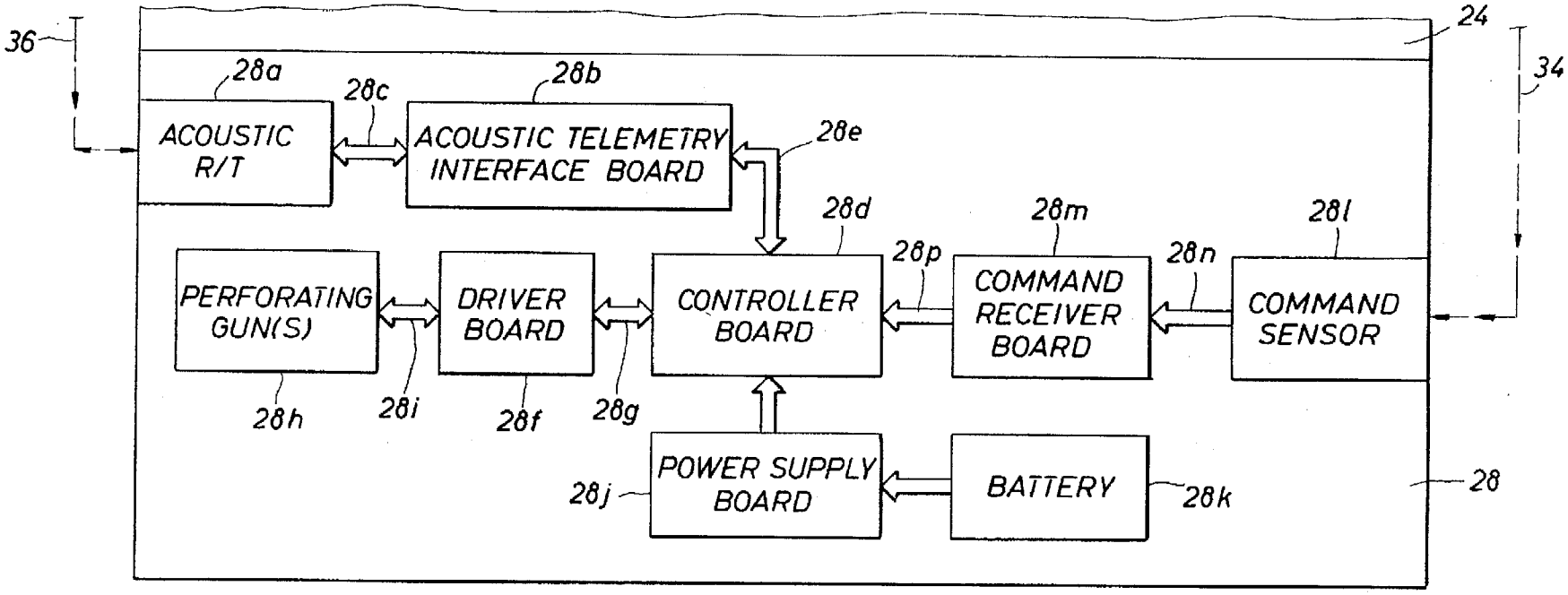

Referring to FIGS. 3 through 5, a detailed construction of the multiple wellbore tool apparatus 14 of FIG. 1 is illustrated.

In FIG. 3, the valve module 26 includes an acoustic receiver transmitter transducer ("acoustic R/T") **26*a* connected to an acoustic telemetry interface board 26b via a first valve bus 26c. The acoustic R/T functions to receive the acoustic signature signal propagating in the wellbore fluid of FIG. 3 (or in the outer housing 15 in FIGS. 6 and 7) via the acoustic data bus 36 and to convert the acoustic signal into an electrical analog signal representative of the signature of the acoustic signature signal. The acoustic telemetry interface board 26b functions to convert the analog signal output from the acoustic R/T 26a into a digital address signal that is representative of the analog output from the acoustic R/T 26a. The acoustic telemetry interface board 26b is connected to a microprocessor implemented controller board ("valve controller board") 26d via a second valve bus 26e. The controller board 26d includes a microprocessor having a processor and a memory, the memory storing a set of microcode programming therein which is unique to the valve module 26. The microprocessor can consist of an Intel 8088 microprocessor manufactured by the Intel Corporation. The valve controller board 26d functions to receive the digital address signal from the acoustic telemetry interface board 40 and generate another digital signal in response thereto. The particular "another digital signal" generated from the valve controller board 26d depends upon the specific microcode software that is encoded within the microprocessor of the valve controller board 26d. The valve controller board 26d is connected to a driver board 26f via a third valve bus 26g. The driver board 26f includes an electrohydraulic mechanism which receives said another digital signal from the valve controller board 26d and provides the necessary hydraulic force necessary to open and close the valve 26h. The driver board 26f is connected to the valve 26h via a fourth valve bus 26i. A power supply board 26j and a battery 26k provide the necessary electric voltage necessary to power the valve controller board 26d as well as the other component parts of the valve module 26. A command sensor 26L receives the input stimulus (the pressure pulses of FIG. 2) having the particular signature propagating down the input stimulus wellbore fluid data bus 34 and generates an electrical analog signal representative of the signature of the input stimulus. The command sensor 26L is electrically connected to a command receiver board 26m via a fifth valve data bus 26n. The command receiver board 26m converts the electrical analog signal on bus 26n from the command sensor 26L into a digital address signal representative of the signature of the input stimulus and the signature of the analog signal and generates the digital address signal. This digital address signal contains the address information which is necessary to address the memory of the microprocessor of the valve controller board 26d. The command receiver board 26m is connected to the valve controller board 26d via a sixth valve bus 26p, the digital address signal from the command receiver board 26m being transmitted to the valve controller board 26d via the sixth valve bus 26p**.

The flowmeter module 20 includes an acoustic receiver transmitter transducer ("acoustic R/T") 20a connected to an acoustic telemetry interface board 20b via a first flowmeter bus 20c. The acoustic R/T 20a functions to receive the acoustic signature signal propagating in the wellbore fluid of FIG. 3 (or in the outer housing 15 of FIGS. 6 and 7) via the acoustic data bus 36 and to convert the acoustic signal into an electrical analog signal representative of the signature of the acoustic signature signal. The acoustic telemetry interface board 20b functions to convert the analog signal output from the acoustic R/T 20a into a digital address signal that is representative of the analog output from the acoustic R/T 20a. The acoustic telemetry interface board 20b is connected to a microprocessor implemented controller board ("flowmeter controller board") 20d via a second flowmeter bus 20e. The controller board 20d includes a microprocessor having a processor and a memory, the memory storing a set of microcode programming therein which is unique to the flowmeter module 20. The microprocessor can consist of an Intel 8088 microprocessor manufactured by the Intel Corporation. The flowmeter controller board 20d functions to receive the digital address signal from the acoustic telemetry interface board 20b and generate another digital signal in response thereto. The particular "another digital signal" generated from the flowmeter controller board 20d depends upon the specific microcode software that is encoded within the microprocessor of the flowmeter controller board 20d. The flowmeter controller board 20d is connected to a flowmeter electronics board 20f via a third flowmeter bus 20g. The flowmeter electronics board 20f receives said another digital signal from the flowmeter controller board 20d via the bus 20g and provides the necessary wake up signal necessary to enable the flowmeter sensors 20h and cause the flowmeter sensors 20h to begin taking its flow measurement readings. The flowmeter electronics board 20f is connected to the flowmeter sensors 20h via a fourth flowmeter bus 20i. A power supply board 20j and a battery 20k provide the necessary electric voltage necessary to power the flowmeter controller board 20d as well as the other component parts of the flowmeter module 20. A command sensor 20L receives the input stimulus (the pressure pulses of FIG. 2) having the particular signature propagating down the input stimulus wellbore fluid data bus 34 and generates an electrical analog signal representative of the signature of the input stimulus. The command sensor 20L is electrically connected to a command receiver board 20m via a fifth flowmeter data bus 20n. The command receiver board 20m converts the electrical analog signal on bus 20n from the command sensor 20L into a digital address signal representative of the signature of the input stimulus and the signature of the analog signal and generates the digital address signal. This digital address signal includes a set of address information which is necessary to address the memory of the microprocessor of the flowmeter controller board 20d. The command receiver board 20m is connected to the flowmeter controller board 20d via a sixth flowmeter bus 20p, the digital address signal from the command receiver board 20m being transmitted from the command receiver board 20m to the microprocessor of the flowmeter controller board 20d via the sixth flowmeter bus 20p.

In FIG. 4, the packer module 18 includes an acoustic receiver transmitter transducer ("acoustic R/T") 18a connected to an acoustic telemetry interface board 18b via a first packer bus 18c. The acoustic R/T functions to receive the acoustic signature signal propagating in the wellbore fluid of FIG. 4 (or in the outer housing 15 of FIGS. 6 and 8) via the acoustic data bus 36 and to convert the acoustic signal into an electrical analog signal representative of the signature of the acoustic signature signal. The acoustic telemetry interface board 18b functions to convert the analog signal output from the acoustic R/T 18a into a digital address signal that is representative of the analog output from the acoustic R/T 18a. The acoustic telemetry interface board 18b is connected to a microprocessor implemented controller board ("packer controller board") 18d via a second packer bus 18e. The controller board 18d includes a microprocessor having a processor and a memory, the memory storing a set of microcode programming therein which is unique to the packer module 18. The microprocessor can consist of an Intel 8088 microprocessor manufactured by the Intel Corporation. The packer controller board 18*d* functions to receive the digital address signal from the acoustic telemetry interface board 18*b* and generate another digital signal in response thereto. The particular "another digital signal" generated from the packer controller board 18*d* depends upon the specific microcode software that is encoded within the microprocessor of the packer controller board 18*d*. The packer controller board 18*d* is connected to a packer driver board 18*f* via a third packer bus 18*g*. The driver board 18*f* includes an electrohydraulic mechanism (such as that which is found in a typical packer setting tool) which receives said another digital signal from the packer controller board 18*d* and provides the necessary hydraulic force necessary to set and unset the packer 18*h*. The packer driver board 18*f* is connected to the packer 18*h* via a fourth packer bus 18*i*. A power supply board 18*j* and a battery 18*k* provide the necessary electric voltage necessary to power the packer controller board 18*d* as well as the other component parts of the packer module 18. A command sensor 18L receives the input stimulus (the pressure pulses of FIG. 2) having the particular signature propagating down the input stimulus wellbore fluid data bus 34 and generates an electrical analog signal representative of the signature of the input stimulus. The command sensor 18L is electrically connected to a command receiver board 18*m* via a fifth packer data bus 18*n*. The command receiver board 18*m* converts the electrical analog signal on bus 18*n* from the command sensor 18L into a digital address signal representative of the signature of the input stimulus and the signature of the analog signal and generates the digital address signal. This digital address signal includes a set of address information which is necessary to address the memory of the microprocessor of the packer controller board 18*d*. The command receiver board 18*m* is connected to the packer controller board 18*d* via a sixth packer bus 18*p*, the digital address signal from the command receiver board 18*m* being transmitted from the command receiver board 18*m* to the microprocessor of the packer controller board 18*d* via the sixth packer bus 18*p*. Recall that Baker Oil Tools, in a brochure having a 1992 copyright date, introduced a microprocessor implemented system, known as the "EAS Downhole Tool Actuation and Control System", that is adapted to be disposed in a wellbore for setting a packer in response to pressure signals transmitted down a tubing string.

In FIG. 4, the recorder module 24 includes an acoustic receiver transmitter transducer ("acoustic R/T") 24*a* connected to an acoustic telemetry interface board 24*b* via a first recorder bus 24*c*. The acoustic R/T functions to receive the acoustic signature signal propagating in the wellbore fluid of FIG. 4 (or in the outer housing 15 of FIGS. 6 and 8) via the acoustic data bus 36 and to convert the acoustic signal into an electrical analog signal representative of the signature of the acoustic signature signal. The acoustic telemetry interface board 24*b* functions to convert the electrical analog output signal from the acoustic R/T 24*a* into a digital address signal that is representative of the analog output from the acoustic R/T 24*a*. The acoustic telemetry interface board 24*b* is connected to a microprocessor implemented controller board ("recorder controller board") 24*d* via a second recorder bus 24*e*. The controller board 24*d* includes a microprocessor having a processor and a memory, the memory storing a set of microcode programming which is unique to the recorder module 24. The microprocessor can consist of an Intel 8088 microprocessor manufactured by the Intel Corporation. The recorder controller board 24*d* functions to receive the digital address signal from the acoustic telemetry interface board 24*b* and generate another digital signal in response thereto. The particular "another digital signal" generated from the recorder controller board 24*d* depends upon the specific microcode software that is encoded within the microprocessor of the recorder controller board 24*d*. The recorder controller board 24*d* is connected to a recorder electronics board 24*f* via a third recorder bus 24*g*. The recorder electronics board 24*f* receives said another digital signal from the recorder controller board 24*d* via the bus 24*g* and provides the necessary wake up signal necessary to enable the recorder sensors 24*h* and cause the recorder sensors 24*h* to begin taking its pressure measurement readings. The recorder electronics board 24*f* is connected to the recorder sensors 24*h* via a fourth recorder bus 24*i*. A power supply board 24*j* and a battery 24*k* provide the necessary electric voltage necessary to power the recorder controller board 24*d* as well as the other component parts of the recorder module 24. A command sensor 24L receives the input stimulus (the pressure pulses of FIG. 2) having the particular signature propagating down the input stimulus wellbore fluid data bus 34 and generates an electrical analog signal representative of the signature of the input stimulus. The command sensor 24L is electrically connected to a command receiver board 24*m* via a fifth recorder data bus 24*n*. The command receiver board 24*m* converts the electrical analog signal on bus 24*n* from the command sensor 24L into a digital address signal representative of the signature of the input stimulus and the signature of the analog signal and generates the digital address signal. This digital address signal includes a set of address information which is necessary to address the memory of the microprocessor of the recorder controller board 24*d*. The command receiver board 24*m* is connected to the recorder controller board 24*d* via a sixth recorder bus 24*p*, the digital address signal from the command receiver board 24*m* being transmitted from the command receiver board 24*m* to the microprocessor of the recorder controller board 24*d* via the sixth recorder bus 24*p*.

In FIG. 5, the perforating gun module 28 includes an acoustic receiver transmitter transducer ("acoustic R/T") 28*a* connected to an acoustic telemetry interface board 28*b* via a first perforating gun bus 28*c*. The acoustic R/T 28*a* functions to receive the acoustic signature signal propagating in the wellbore fluid of FIG. 5 (or in the outer housing 15 of FIGS. 6 and 9) via the acoustic data bus 36 into an electrical analog signal representative of the signature of the acoustic signature signal. The acoustic telemetry interface board 28*b* functions to convert the analog signal output from the acoustic R/T 28*a* into a digital address signal that is representative of the analog output from the acoustic R/T 28*a*. The acoustic telemetry interface board 28*b* is connected to a microprocessor implemented controller board ("perforating gun controller board") 28*d* via a second perforating gun bus 28*e*. The controller board 28*d* includes a microprocessor having a processor and a memory, the memory storing a set of microcode programming therein which is unique to the perforating gun module 28. The microprocessor can consist of an Intel 8088 microprocessor manufactured by the Intel Corporation. The perforating gun controller board 28*d* functions to receive the digital address signal from the acoustic telemetry interface board 28*b* and generate another digital signal in response thereto. The particular "another digital signal" generated from the perforating gun controller board 28*d* depends upon the specific microcode software that is encoded within the microprocessor of the perforating gun controller board 28*d*. The perforating gun controller board 28*d* is connected to a perforating gun driver board 28*f* via a third perforating gun bus 28*g*. The driver board 28*f* includes a digital to analog converter for converting said another digital signal from the perforating gun controller board 28*d* into a direct-current analog voltage signal which is necessary to detonate an exploding foil initiator firing head in the perforating gun(s) 28*a* and to detonate a plurality of shaped charges in the perforating gun(s) 28*h*. The perforating gun driver board 28*f* is connected to the perforating gun 28*h* via a fourth perforating gun bus 28*i*. A power supply board 28*j* and a battery 28*k* provide the necessary electric voltage necessary to power the perforating gun controller board 28*d* as well as the other component parts of the perforating gun module 28. A command sensor 28L receives the input stimulus (the pressure pulses of FIG. 2) having the particular signature propagating down the input stimulus wellbore fluid data bus 34 and generates an electrical analog signal representative of the signature of the input stimulus. The command sensor 28L is electrically connected to a command receiver board 28*m* via a fifth perforating gun data bus 28*n*. The command receiver board 28*m* converts the electrical analog signal on bus 28*n* from the command sensor 28L into a digital address signal representative of the signature of the input stimulus and the signature of the analog signal from the sensor 28L and generates the digital address signal. This digital address signal includes a set of address information which is necessary to address the memory of the microprocessor of the perforating gun controller board 28*d*. The command receiver board 28*m* is connected to the perforating gun controller board 28*d* via a sixth perforating gun bus 28*p*, the digital address signal from the command receiver board 28*m* being transmitted from the command receiver board 28*m* to the microprocessor of the perforating gun controller board 28*d* via the sixth perforating gun bus 28*p*.

Referring to FIGS. 6 through 9, a preferred embodiment of the multiple wellbore tool apparatus 14 of the present invention is illustrated.

The multiple wellbore tool apparatus 14 illustrated in FIGS. 6 through 9 is identical to the multiple wellbore tool apparatus 14 illustrated in FIGS. 1 through 5 except for two differences:

1. The multiple wellbore tool apparatus 14 illustrated in FIGS. 6 through 9 is enclosed by an outer housing 15; and
2. The acoustic data bus 36 in FIGS. 6 through 9 is disposed within the outer housing 15.

In FIGS. 1 through 5, the input stimulus wellbore fluid data bus 34 and the acoustic data bus 36 are both disposed within the wellbore fluid. However, in FIGS. 6 through 9, although the input stimulus wellbore fluid data bus 34 is still disposed within the wellbore fluid, the acoustic data bus 36 is now disposed within the outer housing 15. That is, in FIGS. 6–9, the acoustic signals from one acoustic R/T propagate within the outer housing 15 to all other acoustic R/Ts of the multiple wellbore tool apparatus 14.

In operation, in FIGS. 6 through 9, an input stimulus, in the form of the pressure pulses of FIG. 2, propagate down the input stimulus wellbore fluid data bus 34 of FIGS. 6 through 9. The pressure pulse input stimulus from the wellbore fluid data bus 34 is input to each of the plurality of wellbore tools of the multiple wellbore tool apparatus 14, where the plurality of wellbore tools include the valve module 26, the flowmeter module 20, the packer module 18, the recorder module, 24, and the perforating gun module 28. A particular one of the plurality of wellbore tools in FIGS. 6 through 9 will respond to the input stimulus from the wellbore fluid data bus 34. In FIGS. 6 through 9, when the particular one of the plurality of wellbore tools responds to the input stimulus, an acoustic signal will be transmitted from the acoustic R/T of that particular wellbore tool, the acoustic signal being transmitted into the outer housing 15 of the multiple wellbore tool apparatus 14 of FIGS. 6 through 9. The acoustic signal from the particular wellbore tool propagates within the outer housing 15 and is received in all of the acoustic R/Ts of all of the other wellbore tools of the multiple wellbore tool apparatus 14.

Except for these two differences, the structure and functional operation of the multiple wellbore tool apparatus I4 of FIGS. 1 through 5 is identical to the structure and functional operation of the multiple wellbore tool apparatus of FIGS. 6 through 9.

Figure 10:
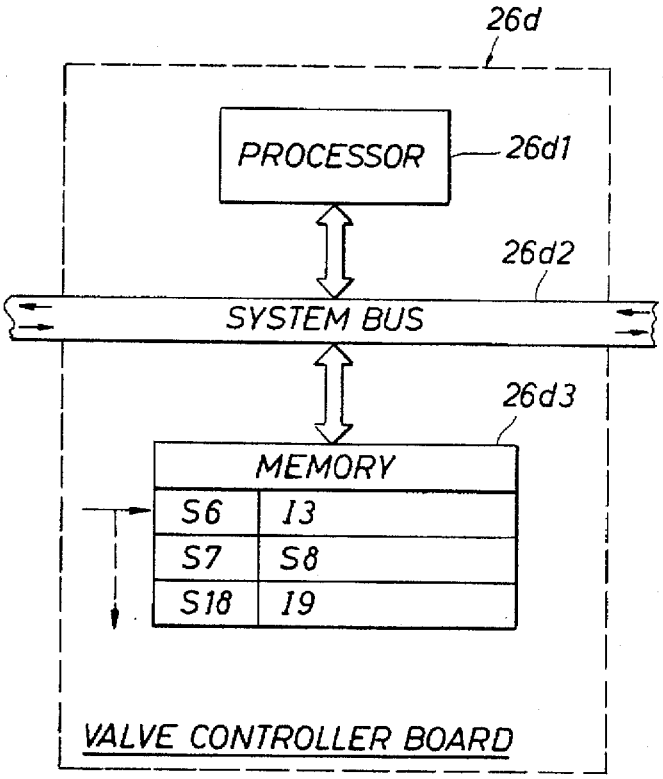
FIG. 10 illustrates a more detailed construction of the microprocessor implemented controller board for the valve wellbore tool.
Figure 7:
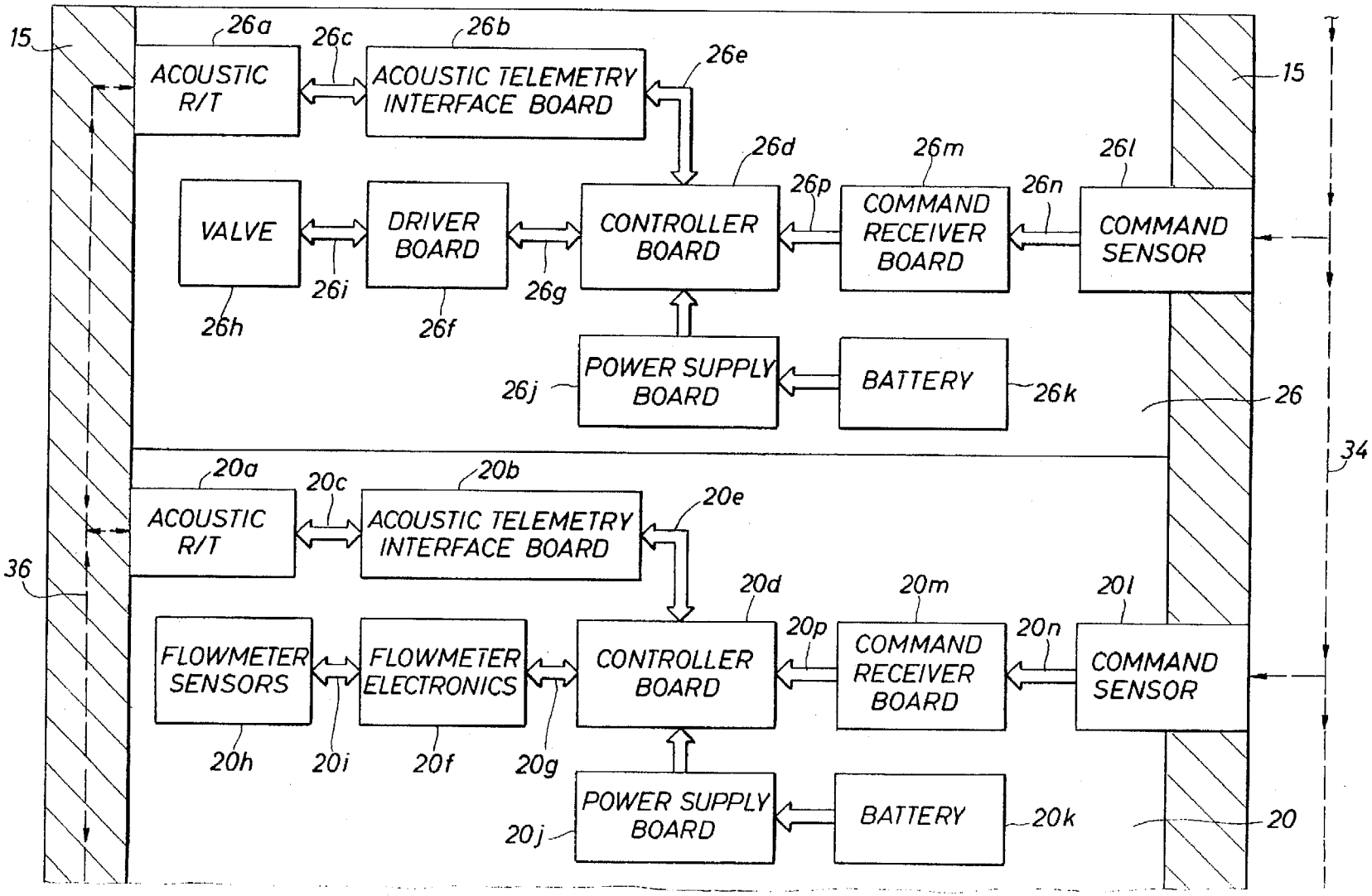
FIGS. 7, 8, and 9 illustrate a more detailed construction of each of the plurality of wellbore tools of the multiple wellbore tool apparatus of FIG. 6.

Referring to FIG. 10, a more detailed construction of the valve controller board 26*d* of the valve module 26 of FIGS. 3 and 7 is illustrated.

In FIG. 10, the valve controller board 26*d* comprises a microprocessor, such as an Intel 8088 microprocessor, which includes a processor 26*d*1 connected to a system bus 26*d*2 and a memory 26*d* 3 connected to the system bus 26*d*2. The memory 26*d* 3 stores a set of microcode programming therein which is unique to the valve module 26. In the memory 26*d*3, there are essentially two columns of stored information: a set of addresses and a set of instructions which correspond, respectively, to the set of addresses. In FIG. 10, the set of addresses include the following: a first address known as an S6 address, a second address known as an S7 address, and a third address known as an S18 address. The set of instructions which correspond, respectively, to the set of addresses include the following: a first instruction known as an I3 instruction which corresponds to the S6 address, a second instruction known as an S8 instruction which corresponds to the S7 address, and a third instruction known as an I9 instruction which corresponds to the S18 address. The significance and the function of these addresses and their instructions will be appreciated from a reading of the functional description provided below.

Figure 11:
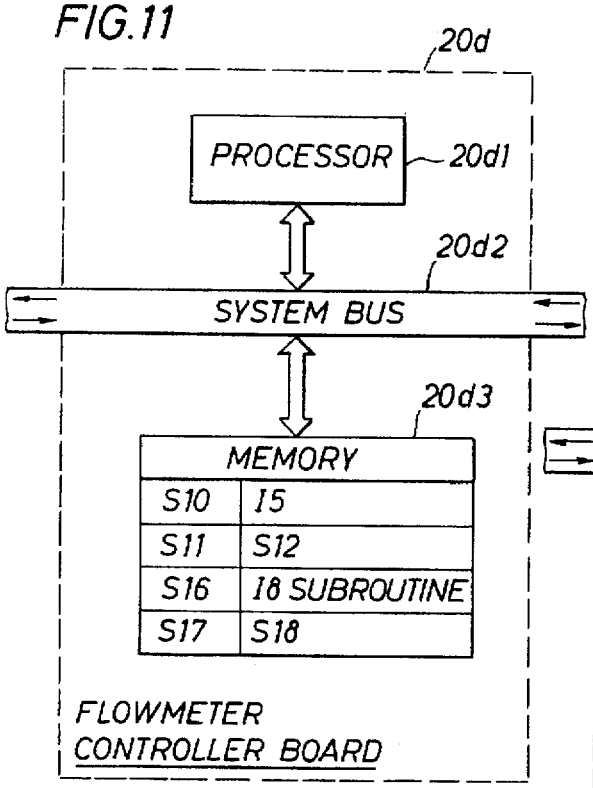
FIG. 11 illustrates a more detailed construction of the microprocessor implemented controller board for the flowmeter wellbore tool.

Referring to FIG. 11, a more detailed construction of the flowmeter controller board 20*d* of the flowmeter module 20 of FIGS. 3 and 7 is illustrated.

In FIG. 11, the flowmeter controller board 20*d* consists of a microprocessor, such as an Intel 8088 microprocessor, which includes a processor 20*d*1 connected to a system bus 20*d*2 and a memory 20*d*3 connected to the system bus 20*d*2 . The memory 20*d*3 stores a set of microcode programming therein which is unique to the flowmeter module 20. In the memory 20*d*3, there are essentially two columns of stored information: a set of addresses and a set of instructions which correspond, respectively, to the set of addresses. In FIG. 11, the set of addresses include the following: a first address known as an S10 address, a second address known as an S11 address, a third address known as an S16 address, and a fourth address known as an S17 address. The set of instructions which correspond, respectively, to the set of addresses include the following: a first instruction known as an I5 instruction which corresponds to the S10 address, a second instruction known as an S12 instruction which corresponds to the S11 address, a third set of instructions known as an "18 subroutine" which correspond to the S16 address, and a fourth instruction known as an S18 instruction which corresponds to the S17 address.

Figure 8:
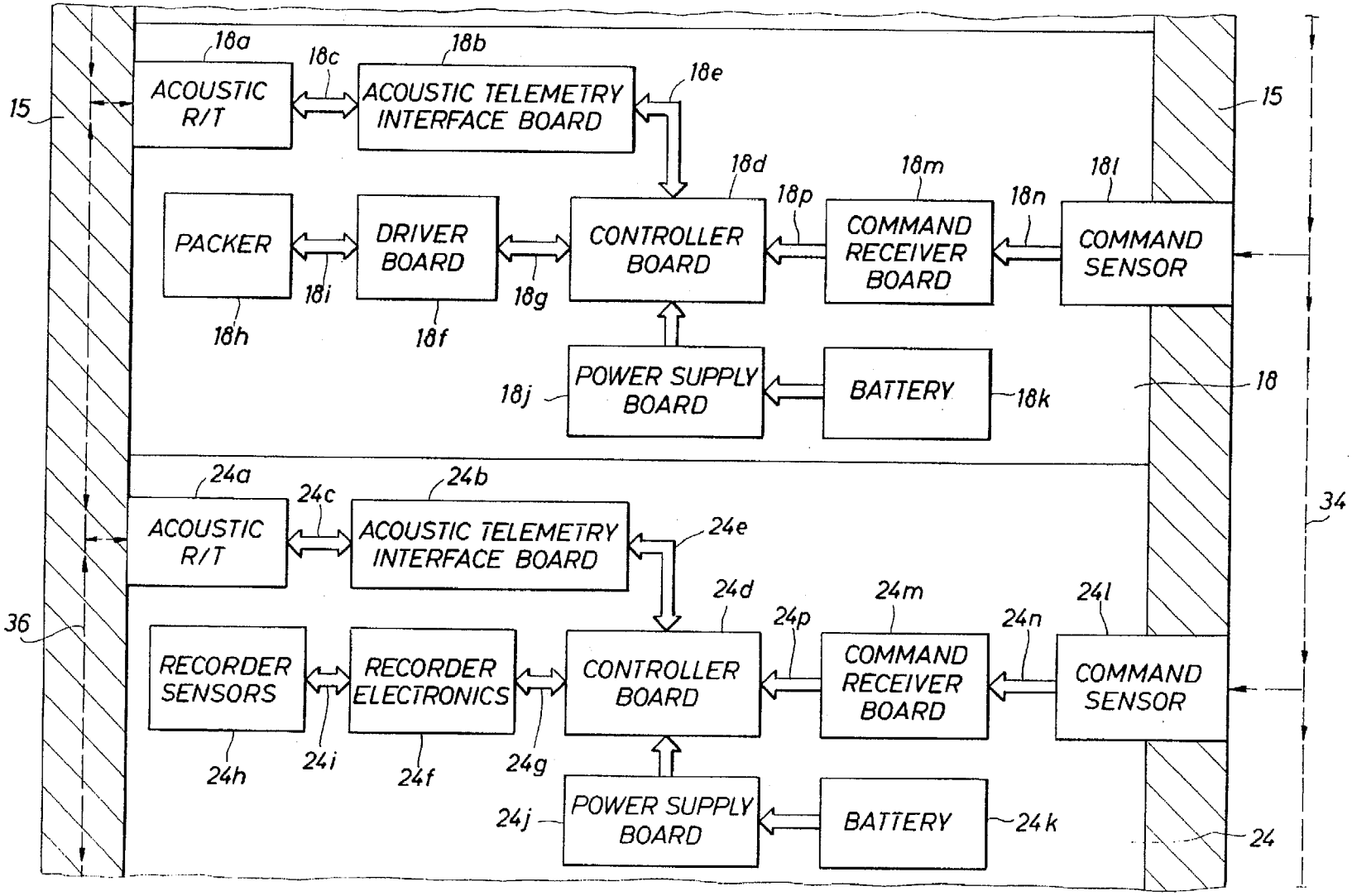
Figure 12:
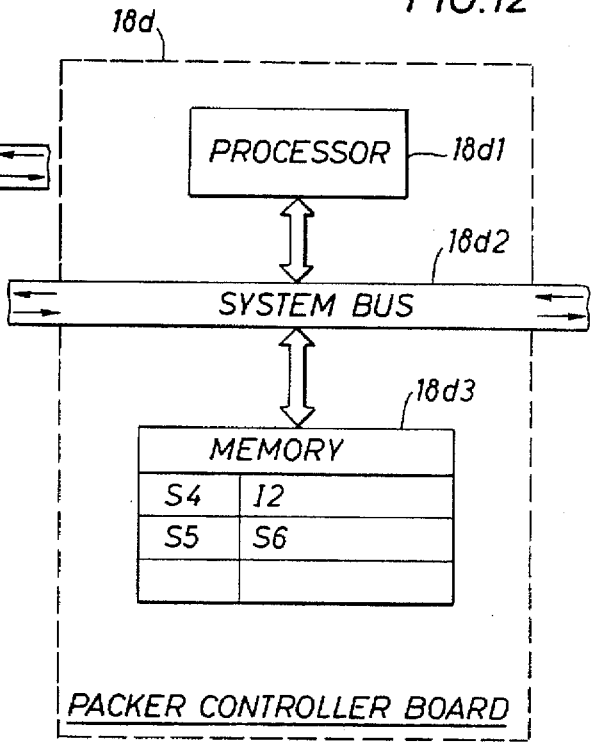
FIG. 12 illustrates a more detailed construction of the microprocessor implemented controller board for the packer wellbore tool.

Referring to FIG. 12, a more detailed construction of the packer controller board 18*d* of the packer module 18 of FIGS. 4 and 8 is illustrated.

In FIG. 12, the packer controller board 18*d* consists of a microprocessor, such as an Intel 8088 microprocessor, which includes a processor 18*d*1 connected to a system bus 18*d*2 and a memory 18*d*3 connected to the system bus 18*d*2.

The memory 18d3 stores a set of microcode programming therein which is unique to the packer module 18. In the memory 18d3, there are essentially two columns of stored information: a set of addresses and a set of instructions which correspond, respectively, to the set of addresses. In FIG. 12, the set of addresses include the following: a first address known as an S4 address and a second address known as an S5 address. The set of instructions which correspond, respectively, to the set of addresses include the following: a first instruction known as an I2 instruction which corresponds to the S4 address and a second instruction known as an S6 instruction which corresponds to the S5 address.

Figure 13:
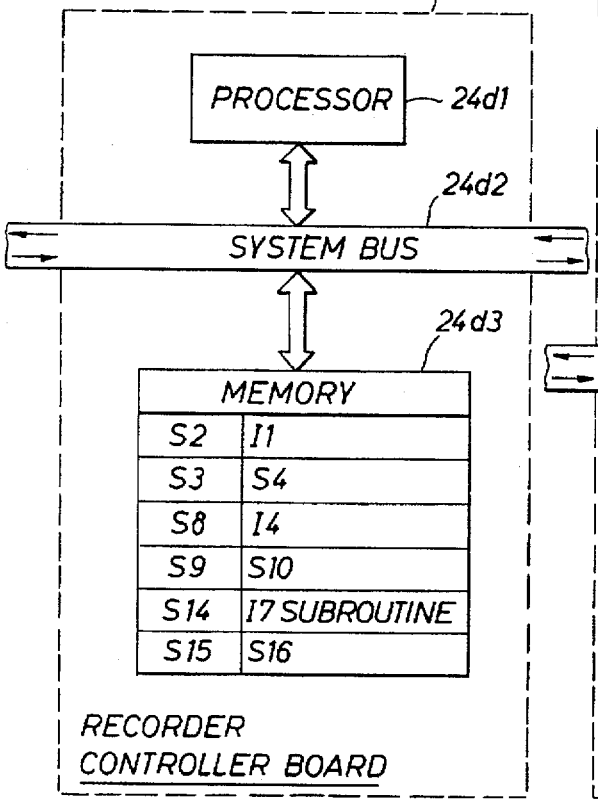
FIG. 13 illustrates a more detailed construction of the microprocessor implemented controller board for the recorder wellbore tool.

Referring to FIG. 13, a more detailed construction of the recorder controller board 24d of the recorder module 24 of FIGS. 4 and 8 is illustrated.

In FIG. 13, the recorder controller board 24d consists of a microprocessor, such as an Intel 8088 microprocessor, which includes a processor 24d1 connected to a system bus 24d2 and a memory 24d3 connected to the system bus 24d2. The memory 24d3 stores a set of microcode programming therein which is unique to the recorder module 24. In the memory 24d3, there are essentially two columns of stored information: a set of addresses and a set of instructions which correspond, respectively, to the set of addresses. In FIG. 13, the set of addresses include the following: a first address known as an S2 address, a second address known as an S3 address, a third address known as an S8 address, a fourth address known as an S9 address, a fifth address known as an S14 address, and a sixth address known as an S15 address. The set of instructions which correspond, respectively, to the set of addresses include the following: a first instruction known as an I1 instruction which corresponds to the S2 address, a second instruction known as an S4 instruction which corresponds to the S3 address, a third instruction known as an I4 instruction which corresponds to the S8 address, a fourth instruction known as an S10 instruction which corresponds to the S9 address, a fifth set of instructions known as an "17 subroutine" which correspond to the S14 address, and a sixth instruction known as an S16 instruction which corresponds to the S15 address.

Figure 9:
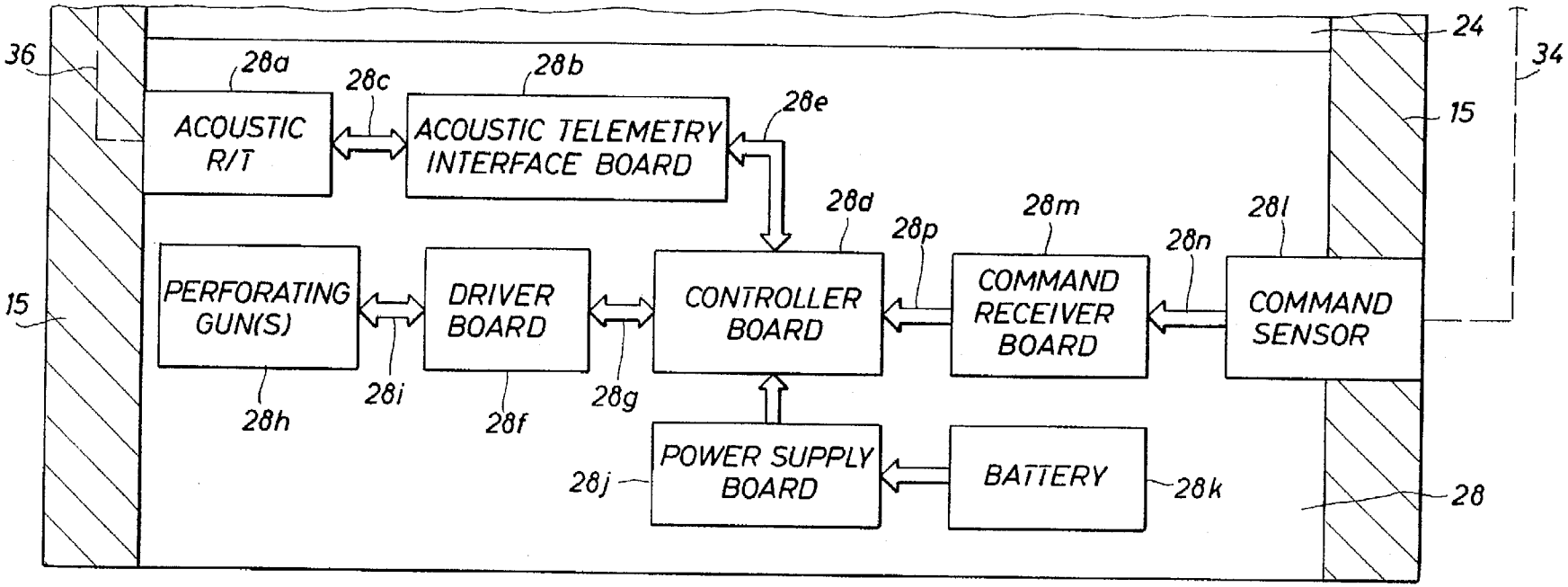
Figure 14:
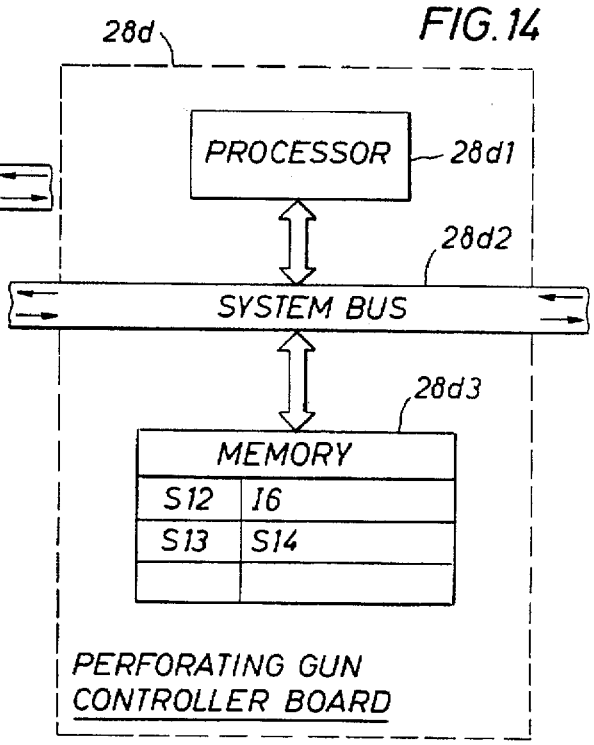
FIG. 14 illustrates a more detailed construction of the microprocessor implemented controller board for the perforating gun wellbore tool.

Referring to FIG. 14, a more detailed construction of the perforating gun controller board 28d of the perforating gun module 28 of FIGS. 5 and 9 is illustrated.

In FIG. 14, the perforating gun controller board 28d consists of a microprocessor, such as an Intel 8088 microprocessor, which includes a processor 28d1 connected to a system bus 28d2 and a memory 28d3 connected to the system bus 28d2. The memory 28d3 stores a set of microcode programming therein which is unique to the perforating gun module 28. In the memory 28d3, there are essentially two columns of stored information: a set of addresses and a set of instructions which correspond, respectively, to the set of addresses. In FIG. 14, the set of addresses include the following: a first address known as an S12 address and a second address known as an S13 address. The set of instructions which correspond, respectively, to the set of addresses include the following: a first instruction known as an I6 instruction which corresponds to the S12 address and a second instruction known as an S14 instruction which corresponds to the S13 address.

Figure 15:
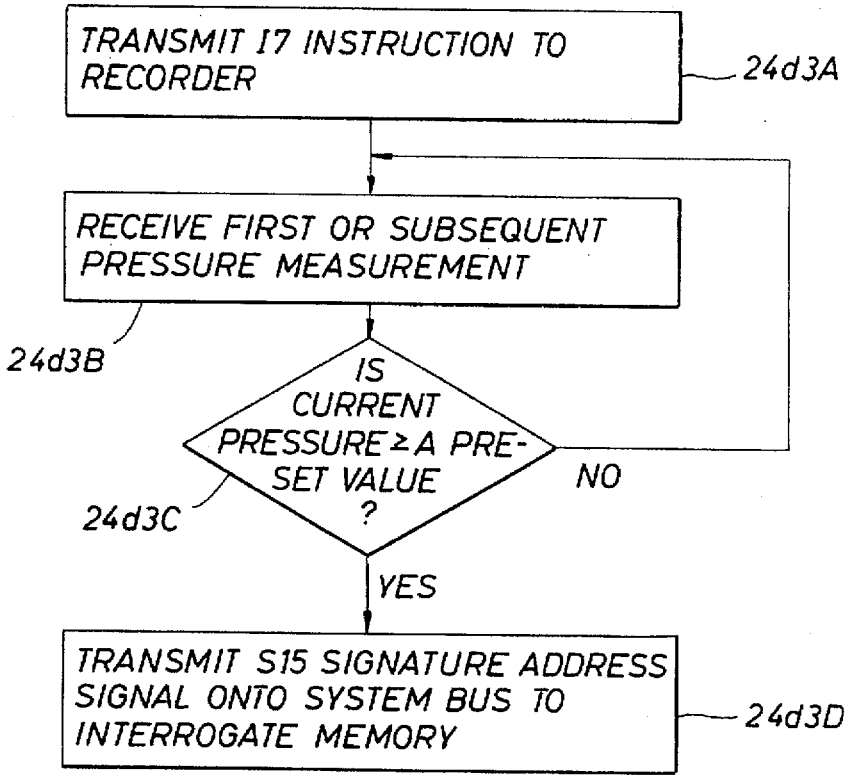
FIG. 15 illustrates a flowchart of the I7 Subroutine stored in the memory of the controller board for the recorder wellbore tool.

Referring to FIG. 15, a flowchart of the 17 subroutine, which is stored in the memory 24d3 of the recorder controller board 24d of FIG. 13, is illustrated.

In FIG. 15, the I7 subroutine includes the following blocks:

1. Transmit an I7 instruction to the recorder, block 24d3A. When a match is made between an incoming signature address signal and the S14 address stored in the memory 24d3 of FIG. 13, the processor 24d1 of the recorder controller board 24d will transmit an I7 instruction to the recorder sensors 24h. In response to the I7 instruction, the recorder sensors 24h will begin taking pressure measurement readings representative of the pressure of a wellbore fluid flowing within the multiple wellbore tool apparatus 14 of FIG. 1 or FIG. 6. During the taking of these pressure measurement readings by the recorder sensors 24h, the recorder sensors 24h will be generating output signals representative of the pressure measurement readings. These output signals, representative of the pressure measurement readings, will be transmitting back from the recorder sensors 24h to the recorder controller board 24d.

2. Receive first or subsequent pressure measurement, block 24d3B.

The output signals from the recorder sensors 24h, representative of the pressure measurement readings, will be received by the processor 24d1 of the recorder controller board 24d. These pressure measurement readings will represent the first pressure measurement reading and all subsequent pressure measurement readings taken by the recorder sensors 24h.

3. Is the current pressure greater than or equal to a preset value, block 24d3C.

The processor 24d1 of the recorder controller board 24d will determine if the first pressure measurement reading, from the output signals from the recorder sensor 24h, is greater than or equal to a predetermined, preset valve. If not, the processor 24d1 will determine if any one of the subsequent pressure measurement readings, from said output signals from the recorder sensors 24h, is greater than or equal to the preset value.

4. Transmit S15 signature address signal onto system bus 24d2 to interrogate memory 24d3, block 24d3D.

When a particular one of the pressure measurement readings from the recorder sensors 24h, as indicated by an output signal from the recorder sensors 24h, is determined by the processor 24d1 of the recorder controller board 24d to be greater than or equal to the preset value, the processor 24d1 of the recorder controller board 24d will transmit an S15 signature address signal onto the system bus 24d2, the S15 signature address signal interrogating the memory 24d3 of the recorder controller board 24d.

Figure 16:
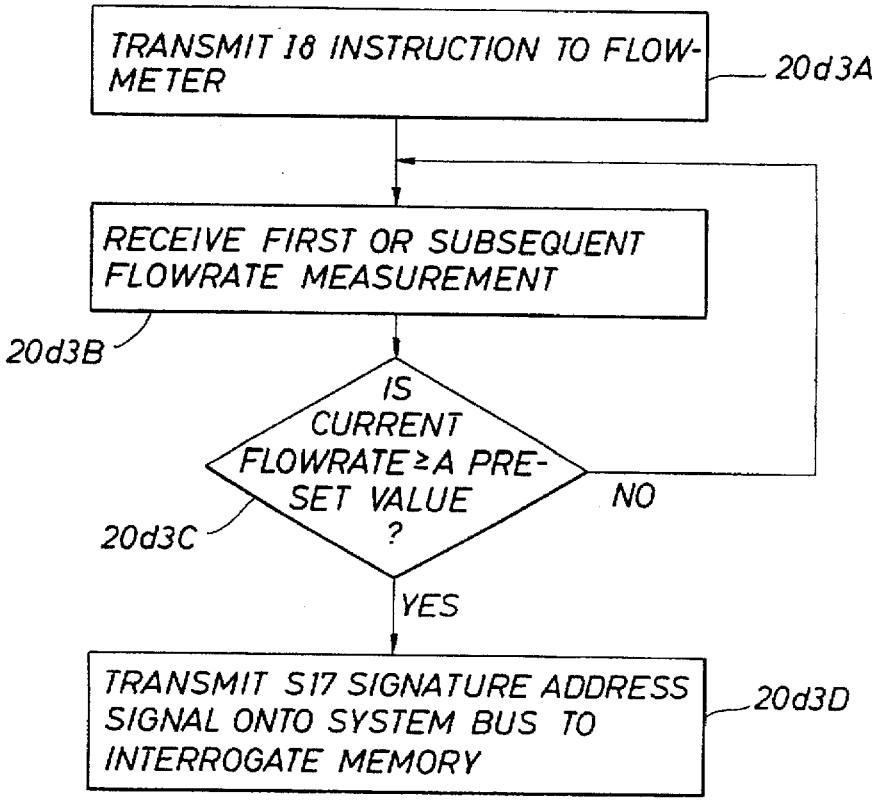
FIG. 16 illustrates a flowchart of the I8 Subroutine stored in the memory of the controller board for the flowmeter wellbore tool.

Referring to FIG. 16, a flowchart of the I8 subroutine stored in the memory 20d3 of the flowmeter controller board 20d of FIG. 11 is illustrated.

In FIG. 16, the I8 subroutine includes the following blocks:

1. Transmit an I8 instruction to the flowmeter, block 20d3A.

When a match is made between an incoming signature address signal and the S16 address stored in the memory 20d3 of FIG. 11, the processor 20d1 of the flowmeter controller board 20d will transmit an I8 instruction to the flowmeter sensors 20h. In response to the I8 instruction, the flowmeter sensors 20h will begin taking flowrate measurement readings representative of the flowrate of a wellbore fluid flowing within the multiple wellbore tool apparatus 14 of FIG. 1 or FIG. 6. During the taking of these flowrate measurement readings by the flowmeter sensors 20h, the flowmeter sensors 20h will be generating output signals representative of the flowrate measurement readings. These output signals, representative of the flowrate measurement readings, will be transmitting back from the flowmeter sensors 20h to the flowmeter controller board 20d.

2. Receive first or subsequent flowrate measurement, block 20d3B.

The output signals from the flowmeter sensors 20h, representative of the flowrate measurement readings, will be received by the processor 20d1 of the flowmeter controller board 20d. These flowrate measurement readings will represent the first flowrate measurement reading and all subsequent flowrate measurement readings.

3. Is the current flowrate greater than or equal to a preset value, block 20d3C.

The processor 20d1 of the flowmeter controller board 20d will determine if the first flowrate measurement reading, from the output signals from the flowmeter sensors 20h, is greater than or equal to a predetermined, preset valve. If not, the processor 20d1 will determine if any one of the subsequent flowrate measurement readings, from said output signals of the flowmeter sensors 20h, is greater than or equal to the preset value.

4. Transmit S17 signature address signal onto system bus 20d2 to interrogate memory 20d3, block 20d3D.

When a particular one of the flowrate measurement readings from the flowmeter 20h, as indicated by an output signal from the flowmeter sensors 20h, is determined by the processor 20d1 of the flowmeter controller board 20d to be greater than or equal to the preset value, the processor 20d1 of the flowmeter controller board 20d will transmit an S17 signature address signal onto the system bus 20d2, the S17 signature address signal interrogating the memory 20d3 of the flowmeter controller board 20d.

Figure 17:
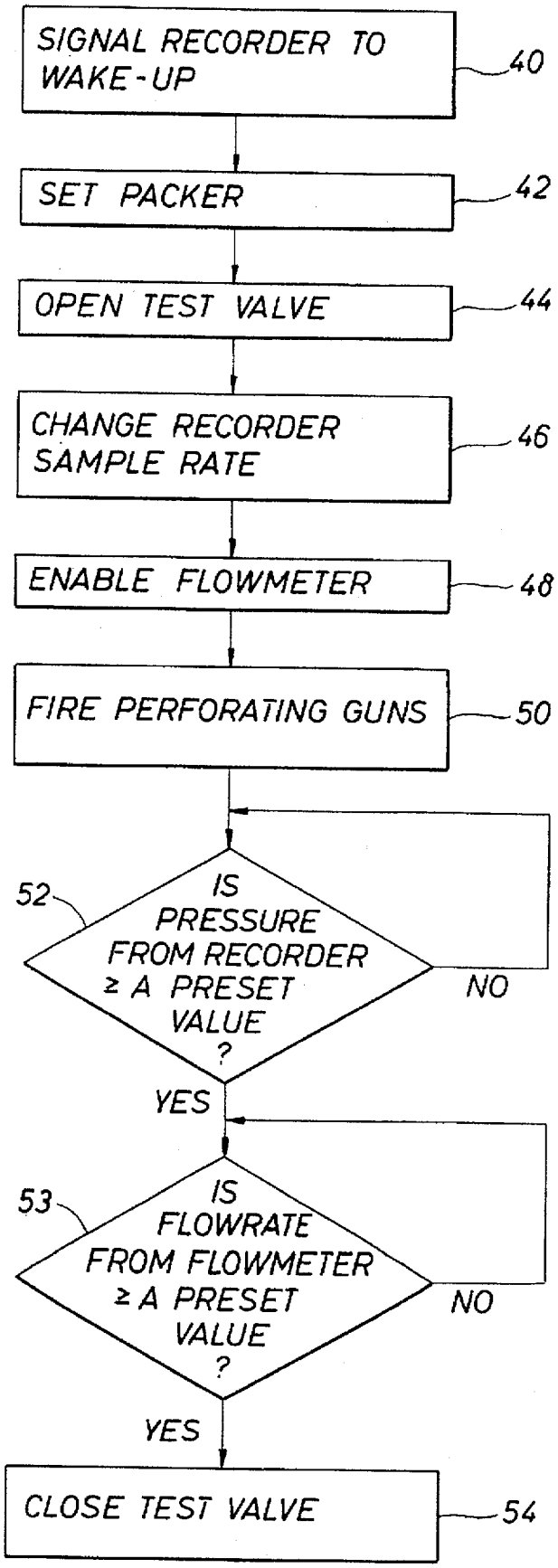
FIG. 17 illustrates a flowchart used in a description of the functional operation of the multiple wellbore tool apparatus of the present invention.

Referring to FIG. 17, a flowchart, used in a description of the functional operation of the multiple wellbore tool apparatus of the present invention, is illustrated.

In FIG. 17, the multiple wellbore tool apparatus 14 of FIG. 1 and FIG. 6 performs the following nine major functional operational steps:

1. Signal recorder 24 to wake up, block 40;
2. Set packer 18, block 42;
3. Open test valve 26, block 44;
4. Change the recorder 24 sample rate, block 46;
5. Enable flowmeter 20, block 48;
6. Fire perforating guns 28, block 50;
7. Determine if the pressure from the pressure recorder sensors 24 is greater than or equal to a preset, predetermined value, block 52;
8. Determine if the flowrate from the flowmeter sensors 20 is greater than or equal to a preset, predetermined value, block 53; and
9. When the pressure reading from the recorder sensors 24 and the flowrate reading from the flowmeter sensors 20 is greater than or equal to a preset, predetermined value, close the test valve 26, block 54.

Functional Operation

A description of the functional operation of the multiple wellbore tool apparatus 14 of FIGS. 1 and 6 of the present invention will be set forth in the following paragraphs with reference to FIGS. 1–17 of the drawings.

FIG. 17 will be used to direct the following functional description of the operation of the multiple wellbore tool apparatus 14 of the present invention shown in FIGS. 1–16.

As shown in FIG. 17, there are nine major functional operational steps practiced by multiple wellbore tool apparatus of FIG. 1 and FIG. 6:

1. Signal recorder 24 to wake up, block 40

In FIGS. 1, 2, and 6, the pressure transmitter 10 of FIGS. 1 and 6 transmits the pressure pulses of FIG. 2 into the annulus region 32. The pressure pulses of FIG. 2, which have been transmitted into the annulus region 32, have a unique encoded signature, and that unique signature contains a special address known as an S2 address. The pressure pulses in region 32 propagate along the input stimulus wellbore fluid data bus 34 and are received by all of the plurality of wellbore tools of the multiple wellbore tool apparatus 14 of FIGS. 1 and 6; that is, the pressure pulses are received by the valve module 26, the flowmeter module 20, the packer module 18, the recorder module 24, and the perforating gun(s) module 28.

In FIGS. 3 through 5 for the FIG. 1 embodiment and FIGS. 7 through 9 for the FIG. 6 embodiment, the command sensors 26L, 20L, 18L, 24L, and 28L of the valve module 26, the flowmeter module 20, the packer module 18, the recorder module 24, and the perforating gun(s) module 28 each receive the pressure pulses having the S2 address from the input stimulus wellbore fluid data bus 34 and convert the pressure pulses into electrical analog signals which also contain the S2 address. The electrical analog signals from each of the command sensors 26L, 20L, 18L, 24L, and 28L propagate along the data buses 26n, 20n, 18n, 24n, and 28n to the command receiver boards 26m, 20m, 18m, 24m and 28m of the valve module 26, the flowmeter module 20, the packer module 18, the recorder module 24, and the perforating gun(s) module 28. These command receiver boards 26m, 20m, 18m, 24m and 28m convert the electrical analog signals having the S2 address into digital signals which also include the S2 address. These digital signals, which include the S2 address, propagate along the data buses 26p, 20p, 18p, 24p, and 28p to the controller boards 26d, 20d, 18d, 24d, and 28d of the valve, flowmeter, packer, recorder, and perforating gun modules.

However, in FIGS. 10–14, as noted earlier, the memories 26d3, 20d3, 18d3, 24d3, and 28d3 of all of the controller boards 26d, 20d, 18d, 24d, and 28d include an address column, and an inspection of each of the addresses in each address column of all of the memories 26d3, 20d3, 18d3, 24d3, and 28d3 will reveal that only one (1) memory contains an S2 address, and that memory is the memory 24d3 of the recorder controller board 24d.

In FIG. 13, the first address in the address column of the memory 24d3 of the recorder controller board 24d is an S2 address. No other memories in any of the other controller boards include or contain the S2 address. Therefore, when the digital signal, which includes the S2 address, is received by the recorder controller board 24d of FIG. 13 from the data bus 24p of FIGS. 4 and 8, the processor 24d1 of FIG. 13 will compare the S2 address of the incoming digital signal on bus 24p from the command receiver board 24m with the S2 address stored in the address column of the memory 24d3 and determine that a match exists between the S2 address of the incoming digital signal and the S2 address stored in the memory 24d3. As a result, the I1 instruction, which corresponds to the S2 address in memory 24d3, will be read from the memory 24d3 by processor 24d1. The digital electronics of the processor 24d1 directs the I1 instruction to the recorder electronics 24f via the data bus 24g. Since the recorder electronics 24f are electrically connected to the recorder sensors 24h via the data bus 24i, in response to the I1 instruction, the recorder electronics 24f will send an electrical digital signal to the recorder sensors 24h; and that electrical signal will "wake up" the recorder 24h. As a result, the recorder sensors 24h are now ready to begin taking pressure measurement readings. These pressure measurement readings represent the pressure of a wellbore fluid which will flow within the multiple wellbore tool apparatus 14 of FIGS. 1 and 6 when the perforating guns 28 perforate a formation traversed by the wellbore 12 of FIGS. 1 and 6.

However, the sample rate (the rate at which samples of the pressure measurements will be taken by the recorder sensors 24h) is not correct and must be corrected. The sample rate will be changed later (discussed below) during the functional description of the operation of the present invention.

2. Set packer 18, block 42

In FIGS. 4, 8, and 13, the recorder sensors 24h sends a signature confirmation signal back to the recorder controller board 24d via the bus 24i, the recorder electronics 24f, and the bus 24g of FIGS. 4 and 8, the signature confirmation signal having an S3 address encoded therein. The controller board 24d of FIG. 13 will receive the S3 address that is encoded in the signature confirmation signal originating from the recorder sensors 24h. The processor 24d1 of the recorder controller board 24d will attempt to find a match between the S3 address in the confirmation signal and the addresses stored in memory 24d3. The processor 24d 1 will find a match between the incoming S3 address in the confirmation signal on bus 24g with an address S3 stored in memory 24d3. As a result, when the match is found, the S4 instruction, which corresponds to the S3 address in memory 24d3, will be read from the memory 24d 3 by processor 24d1. The processor 24d1 of the recorder controller board 24d of FIGS. 4 and 8 will direct the S4 instruction (which is a digital signal) to the acoustic telemetry interface board 24b, where the interface board 24b will convert the incoming digital S4 instruction signal into an analog S4 instruction signal which represents the digital S4 instruction and has encoded therein an S4 address. The analog S4 instruction signal will propagate along bus 24c to the acoustic receiver transmitter (acoustic R/T) 24a, where the acoustic R/T 24a will convert the incoming analog S4 instruction signal from bus 24c into acoustic signals, the acoustic signals representing the analog S4 instruction signal and having encoded therein the same S4 address. The acoustic signals propagate along the acoustic data bus 36 in FIGS. 3 through 5 and 7 through 9, and are received in the acoustic R/T's of all of the plurality of wellbore tools of the multiple wellbore tool apparatus 14 of FIGS. 1 and 6.

In FIGS. 3 through 5 and 7 through 9, the acoustic signals having the S4 address propagate along the acoustic data bus 36, and are received in the acoustic R/T 26a, 20a, 18a, and 28a of the valve module 26, the flowmeter module 20, the packer module 18, and the perforating gun module 28 of the multiple wellbore tool apparatus 14 of FIGS. 1 and 6. These acoustic R/Ts will convert the incoming acoustic signals (having the S4 address) into corresponding electrical analog signals also having the S4 address encoded therein. The acoustic telemetry interface boards 26b, 20b, 18b, and 28b convert their corresponding incoming electrical analog signals having the S4 address into corresponding digital signals also having the S4 address encoded therein, and these digital signals, having the S4 address, propagate along the buses 26e, 20e, 18e, and 28e to the controller boards 26d, 20d, 18d, and 28d of the valve module 26, the flowmeter module 20, the packer module 18, and the perforating gun module 28.

An examination of the memories of the controller boards 26d, 20d, 18d, and 28d in FIGS. 10–14 will reveal that the memory 18d3 of the packer controller board 18d is the only memory in which an S4 address is encoded. Accordingly, when the digital signal having the S4 address is received from the packer acoustic telemetry interface board 18b of FIGS. 4 and 8 via the bus 18e and into the packer controller board 18d of FIG. 12, the processor 18d1 in FIG. 12 will determine that there is a match between the S4 address in the digital signal from bus 18e and the S4 address stored in memory 18d3. As a result, the digital I2 instruction which corresponds to the S4 address in memory 18d3 will be read from memory 13d3 by processor 18d1. The processor 18d1 will direct the I2 instruction, via its digital electronics, to the driver board 18f in FIGS. 4 and 8 via bus 18g. The driver board 18f (which comprises a digital electronics board and an electro-hydraulics mechanism connected to the digital electronics board) will respond to the digital I2 instruction by allowing its digital electronics board to energize its electro hydraulics mechanism, which mechanism will then set the packer 18h of the packer module 18 in FIGS. 4 and 8.

3. Open test valve 26, block 44

In FIGS. 4, 8, and 12, the packer 18h sends a signature confirmation signal back to the packer controller board 18d via the bus 18i, the driver board 18f, and the bus 18g of FIGS. 4 and 8, this signature confirmation signal having an S5 address encoded therein. The controller board 18d of FIG. 12 will receive the S5 address that is encoded in the signature confirmation signal originating from the packer 18h. The processor 18d1 of the packer controller board 18d will attempt to find a match between the S5 address in the confirmation signal and the addresses stored in memory 13d3. The processor 18d1 will find a match between the incoming S5 address in the confirmation signal on bus 18g with an address S5 stored in memory 13d3. As a result, when the match is found, the S6 instruction, which corresponds to the S5 address in memory 13d3, will be read from the memory 13d3 by processor 18d1. The processor 18d1 of the packer controller board 18d of FIGS. 4 and 8 will direct the S6 instruction (which is a digital signal) to the acoustic telemetry interface board 18b, where the interface board 18b will convert the incoming digital S6 instruction signal into an analog S6 instruction signal which represents the digital S6 instruction and has encoded therein an S6 address. The analog S6 instruction signal will propagate along bus 18c to the acoustic receiver transmitter (acoustic R/T) 18a, where the acoustic R/T 18a will convert the incoming analog S6 instruction signal from bus 18c into acoustic signals, the acoustic signals representing the analog S6 instruction signal and having encoded therein the same S6 address. The acoustic signals propagate along the acoustic data bus 36 in FIGS. 3 through 5 and 7 through 9 and are received in the acoustic R/T's of all of the other wellbore tools of the multiple wellbore tool apparatus 14 of FIGS. 1 and 6.

In FIGS. 3 through 5 and 7 through 9, the acoustic signals having the S6 address propagate along the acoustic data bus 36 and are received in the acoustic R/T 26a, 20a, 24a, and 28a of the valve module 26, the flowmeter module 20, the recorder module 24 and the perforating gun module 28 of the multiple wellbore tool apparatus 14 of FIGS. 1 and 6. These acoustic R/Ts will convert the incoming acoustic signals (having the S6 address) into corresponding electrical analog signals also having the S6 address encoded therein. The acoustic telemetry interface boards 26b, 20b, 24b, and 28b convert their corresponding incoming electrical analog signals having the S6 address into corresponding digital signals also having the S6 address encoded therein, and these digital signals, having the S6 address, propagate along the buses 26e, 20e, 24e, and 28e to the controller boards 26d, 20d, 24d, and 28d of the valve module 26, the flowmeter module 20, the recorder module 24, and the perforating gun module 28 of FIGS. 3 through 5 and 7 through 9.

An examination of the memories of the controller boards 26d, 20d, 24d, and 28d in FIGS. 10–11 and 13–14 will reveal that the memory 26d3 of the valve controller board 26d of FIG. 10 is the only memory in which an S6 address is encoded. Accordingly, when the digital signal having the S6 address is received from the valve acoustic telemetry interface board 26b of FIGS. 3 and 7 via the bus 26e and into the valve controller board 26d of FIG. 10, the processor 26d1 in FIG. 10 will determine that there is a match between the S6 address in the digital signal from bus 26e with the S6 address stored in memory 26d3. As a result, the digital I3 instruction, which corresponds to the S6 address in memory 26d3, will be read from memory 26d3 by processor 26d1. The processor 26d1 will direct the I3 instruction, via its digital electronics, to the driver board 26f in FIGS. 3 and 7 via bus 26g. The driver board 26f (which comprises a digital electronics board and an electro-hydraulics mechanism connected to the digital electronics board) will respond to the digital I3 instruction by allowing its digital electronics board to energize its electro hydraulics mechanism, which mechanism will then open the test valve 26h of the valve module 26 in FIGS. 3 and 7, block 44 of FIG. 17.

4. Change the recorder 24 sample rate, block 46

In FIGS. 3, 7, and 10, the test valve 26h sends a signature confirmation signal back to the valve controller board 26d via the bus 26i, the driver board 26f, and the bus 26g of FIGS. 3 and 7, this signature confirmation signal having an S7 address encoded therein. The controller board 26d of FIG. 10 will receive the S7 address that is encoded in the signature confirmation signal originating from the test valve 26h. The processor 26d1 of the valve controller board 26d will attempt to find a match between the S7 address in the confirmation signal and the addresses stored in memory 26d3. The processor 26d1 will find a match between the incoming 87 address in the confirmation signal on bus 26g and an address S7 stored in memory 26d3. As a result, when the match is found, the S8 instruction, which corresponds to the S7 address in memory 26d3, will be read from the memory 26d3 by processor 26d1. The processor 26d1 of the valve controller board 26d1 of FIGS. 3 and 7 will direct the S8 instruction (which is a digital signal) to the acoustic telemetry interface board 26b, where the interface board 26b will convert the incoming digital S8 instruction signal into an analog S8 instruction signal which represents the digital S8 instruction and has encoded therein an S8 address. The analog S8 instruction signal will propagate along bus 26c to the acoustic receiver transmitter (acoustic R/T) 26a, where the acoustic R/T 26a will convert the incoming analog S8 instruction signal from bus 26c into acoustic signals, the acoustic signals representing the analog S8 instruction signal and having encoded therein the same S8 address. The acoustic signals propagate along the acoustic data bus 36 in FIGS. 3 through 5 and 7 through 9 and are received in the acoustic R/T's of all of the other wellbore tools of the multiple wellbore tool apparatus 14 of FIGS. 1 and 6.

In FIGS. 3 through 5 and 7 through 9, the acoustic signals having the S8 address propagate along the acoustic data bus 36 and are received in the acoustic R/T 20a, 18a, 24a, and 28a of the flowmeter module 20, the packer module 18, the recorder module 24 and the perforating gun module 28 of the multiple wellbore tool apparatus 14 of FIGS. 1 and 6. These acoustic R/Ts will convert the incoming acoustic signals (having the S8 address) into corresponding electrical analog signals also having the S8 address encoded therein. The acoustic telemetry interface boards 20b, 18b, 24b, and 28b convert their corresponding incoming electrical analog signals having the S8 address into corresponding digital signals also having the S8 address encoded therein, and these digital signals, having the S8 address, propagate along the buses 20e, 18e, 24e, and 28e to the controller boards 20d, 18d, 24d, and 28d of the flowmeter module 20, the packer module 18, the recorder module 24, and the perforating gun module 28 of FIGS. 3 through 5 and 7 through 9.

An examination of the memories of the controller boards 20d, 18d, 24d, and 28d in FIGS. 11–14 will reveal that the memory 24d3 of the recorder controller board 24d of FIG. 13 is the only memory in which an S8 address is encoded. Accordingly, when the digital signal having the S8 address is received from the recorder acoustic telemetry interface board 24b of FIGS. 4 and 8 via the bus 24e and into the recorder controller board 24d of FIG. 13, the processor 24d1 in FIG. 13 will determine that there is a match between the S8 address in the digital signal from bus 24e with the S8 address stored in memory 24d3. As a result, the digital I4 instruction, which corresponds to the S8 address in memory 24d3, will be read from memory 24d3 by processor 24d1. The processor 24d1 will direct the digital I4 instruction, via its digital electronics, to the recorder electronics board 24f in FIGS. 4 and 8 via bus 24g. The recorder electronics board 24f will respond to the digital I4 instruction from the recorder controller board 24d by generating an output signal. Recall that the recorder sensor 24h is designed to sample the pressure of the wellbore fluid which will flow within the multiple wellbore tool apparatus 14 of FIGS. 1 and 6 when the perforating gun 28h perforates the formation traversed by the wellbore 12. Accordingly, in response to the output signal from the recorder electronics board 24f, the recorder sensors 24h will change its sample rate from a first sample rate to a second sample rate, block 46 of FIG. 17. The term "sample rate" is defined to be the rate at which the recorder sensors 24h will sample the pressure of the wellbore fluid flowing within the multiple wellbore tool apparatus 14 of FIGS. 1 and 6.

5. Enable flowmeter 20, block 48

In FIGS. 4, 8, and 13, the recorder 24h sends a signature confirmation signal back to the recorder controller board 24d via the bus 24i, the driver board 24f, and the bus 24g of FIGS. 4 and 8, this signature confirmation signal having an S9 address encoded therein. The recorder controller board 24d of FIG. 13 will receive the S9 address that is encoded in the signature confirmation signal originating from the recorder sensors 24h. The processor 24d1 of the recorder controller board 24d will attempt to find a match between the S9 address in the confirmation signal and the addresses stored in memory 24d3. The processor 24d1 will find a match between the incoming S9 address in the confirmation signal on bus 24g and an S9 address stored in memory 24d3. As a result, when the match is found, an S10 instruction, which corresponds to the S9 address in memory 24d3, will be read from the memory 24d3 by processor 24d1. The processor 24d1 of the recorder controller board 24d of FIGS. 4 and 8 will direct the S10 instruction (which is a digital signal) to the acoustic telemetry interface board 24b, where the interface board 24b will convert the incoming digital S10 instruction signal into an analog S10 instruction signal which represents the digital S10 instruction and has encoded therein an S10 address. The analog S10 instruction signal will propagate along bus 24c to the acoustic receiver transmitter (acoustic R/T) 24a, where the acoustic R/T 24a will convert the incoming analog S10 instruction signal from bus 24c into acoustic signals, the acoustic signals representing the analog S10 instruction signal and having encoded therein the same S10 address. The acoustic signals propagate along the acoustic data bus 36 in FIGS. 3 through 5 and 7 through 9 and are received in the acoustic R/T's of all of the other wellbore tools of the multiple wellbore tool apparatus 14 of FIGS. 1 and 6.

In FIGS. 3 through 5 and 7 through 9, the acoustic signals having the S10 address propagate along the acoustic data bus 36 and are received in the acoustic R/T 26a, 20a, 18a, and 28*a* of the valve module 26, the flowmeter module 20, the packer module 18, and the perforating gun module 28 of the multiple wellbore tool apparatus 14 of FIGS. 1 and 6. These acoustic R/Ts will convert the incoming acoustic signals (having the S10 address) into corresponding electrical analog signals also having the S10 address encoded therein. The acoustic telemetry interface boards 26*b*, 20*b*, 18*b*, and 28*b* convert their corresponding incoming electrical analog signals having the S10 address into corresponding digital signals also having the S10 address encoded therein, and these digital signals, having the S10 address, propagate along the buses 26*e*, 20*e*, 18*e*, and 28*e* to the controller boards 26*d*, 20*d*, 18*d*, and 28*d* of the valve module 26, the flowmeter module 20, the packer module 18, and the perforating gun module 28 of FIGS. 3 through 5 and 7 through 9.

An examination of the memories of the controller boards 26*d*, 20*d*, 18*d*, and 28*d* in FIGS. 10–12 and 14 will reveal that the memory 20*d*3 of the flowmeter controller board 20*d* of FIG. 11 is the only memory in which an S10 address is encoded. Accordingly, when the digital signal having the S10 address is received from the flowmeter acoustic telemetry interface board 20*b* of FIGS. 3 and 7 via the bus 20*e* and into the flowmeter controller board 20*d* of FIG. 11, the processor 20*d*1 in FIG. 11 will determine that there is a match between the S10 address in the digital signal from bus 20*e* and the S10 address stored in memory 20*d*3. As a result, the digital I5 instruction, which corresponds to the S10 address in memory 20*d*3, will be read from memory 20*d*3 by processor 20*d*1. The processor 20*d*1 will direct the digital I5 instruction, via its digital electronics, to the flowmeter electronics board 20*f* in FIGS. 3 and 7 via bus 20*g*. The flowmeter electronics board 20*f* will respond to the digital I5 instruction from the flowmeter controller board 20*d* by generating an electrical output signal. Recall that the flowmeter 20*h* is designed to measure the flowrate of the wellbore fluid which will flow within the multiple wellbore tool apparatus 14 of FIGS. 1 and 6 when the perforating gun 28*h* perforates the formation traversed by the wellbore 12. Accordingly, in response to the output signal from the flowmeter electronics board 20*f*, the flowmeter sensors 20*h* will be enabled, block 48 of FIG. 17. Since the flowmeter sensors 20*h* are now enabled, when an I8 instruction is received by the flowmeter sensors 20*h* from the processor 20*d*1 of the flowmeter controller board 20*d* (as discussed in more detail below), the flowmeter sensors 20*h* will begin to take measurements of the flowrate of the wellbore fluid flowing within the multiple wellbore tool apparatus 14 of FIGS. 1 and 6.

6. Fire perforating guns 28, block 50

In FIGS. 3, 7, and 11, the flowmeter sensors 20*h* send a signature confirmation signal back to the flowmeter controller board 20*d* via the bus 20*i*, the flowmeter electronics 20*f*, and the bus 20*g* of FIGS. 3 and 7, this signature confirmation signal having an S11 address encoded therein. The flowmeter controller board 20*d* of FIG. 11 will receive the S11 address that is encoded in the signature confirmation signal originating from the flowmeter 20*h*. The processor 20*d*1 of the flowmeter controller board 20*d* will attempt to find a match between the S11 address in the confirmation signal and the addresses stored in memory 20*d*3. The processor 20*d*1 will find a match between the incoming S11 address in the confirmation signal on bus 20*g* with an address S11 stored in memory 20*d*3. As a result, when the match is found, the S12 instruction, which corresponds to the S11 address in memory 20*d*3, will be read from the memory 20*d*3 by processor 20*d*1. The processor 20*d*1 of the flowmeter controller board 20*d* of FIGS. 3 and 7 will direct the S12 instruction (which is a digital signal) to the acoustic telemetry interface board 20*b*, where the interface board 20*b* will convert the incoming digital S12 instruction signal into an analog S12 instruction signal which represents the digital S12 instruction and has encoded therein an S12 address. The analog S12 instruction signal will propagate along bus 20*c* to the acoustic receiver transmitter (acoustic R/T) 20*a*, where the acoustic R/T 20*a* will convert the incoming analog S12 instruction signal from bus 20*c* into acoustic signals, the acoustic signals representing the analog S12 instruction signal and having encoded therein the same S12 address. The acoustic signals propagate along the acoustic data bus 36 in FIGS. 3 through 5 and 7 through 9 and are received in the acoustic R/T's of all of the other wellbore tools of the multiple wellbore tool apparatus 14 of FIGS. 1 and 6.

In FIGS. 3 through 5 and 7 through 9, the acoustic signals having the S12 address propagate along the acoustic data bus 36 and are received in the acoustic R/T 26*a*, 18*a*, 24*a*, and 28*a* of the valve module 26, the packer module 18, the recorder module 24 and the perforating gun module 28 of the multiple wellbore tool apparatus 14 of FIGS. 1 and 6. These acoustic R/Ts will convert the incoming acoustic signals (having the S12 address) into corresponding electrical analog signals also having the S12 address encoded therein. The acoustic telemetry interface boards 26*b*, 18*b*, 24*b*, and 28*b* convert their corresponding incoming electrical analog signals having the S12 address into corresponding digital signals also having the S12 address encoded therein, and these digital signals, having the S12 address, propagate along the buses 26*e*, 18*e*, 24*e*, and 28*e* to the controller boards 26*d*, 18*d*, 24*d*, and 28*d* of the valve module 26, the packer module 18, the recorder module 24, and the perforating gun module 28 of FIGS. 3 through 5 and 7 through 9.

An examination of the memories of the controller boards 26*d*, 18*d*, 24*d*, and 28*d* in FIGS. 10, 12–14 will reveal that the memory 28*d*3 of the perforating gun controller board 28*d* of FIG. 14 is the only memory in which an S12 address is encoded. Accordingly, when the digital signal having the S12 address is received from the perforating gun acoustic telemetry interface board 28*b* of FIGS. 5 and 9 via the bus 28*e* and into the perforating gun controller board 28*d* of FIG. 14, the processor 28*d*1 in FIG. 14 will determine that there is a match between the S12 address in the digital signal from bus 28*e* and the S12 address stored in memory 28*d*3. As a result, the digital I6 instruction, which corresponds to the S12 address in memory 28*d*3, will be read from memory 28*d*3 by processor 28*d*1 of the perforating gun module 28. The processor 28*d*1 will direct the I6 instruction, via its digital electronics, to the driver board 28*f* in FIGS. 5 and 9 via bus 28*g*. The driver board 28*f* (which comprises a D-to-A converter, that is, a digital signal to direct current analog signal converter) will respond to the digital I6 instruction by converting the digital I6 instruction into an analog DC signal. The analog DC signal will energize a firing head for a perforating gun of the type disclosed in prior pending application Ser. No. 08/116,082, filed Sep. 1, 1993, entitled "Firing System for a Perforating Gun including an Exploding Foil Initiator and an Outer Housing for Conducting Wireline Current and EFI Current", the disclosure of which is incorporated by reference into this specification. The firing head will detonate the perforating gun(s) 28*h* in FIGS. 5 and 9, block 50 of FIG. 17.

7. Determine if the pressure from the pressure recorder sensors 24 is greater than or equal to a preset, predetermined value, block 52;

In FIGS. 5, 9, and 14, the perforating gun 28*h* sends a signature confirmation signal back to the perforating gun controller board 28d via the bus 28i, the perforating gun driver board 28f, and the bus 28g of FIGS. 5 and 9, this signature confirmation signal having an S13 address encoded therein. The perforating gun controller board 28d of FIG. 14 will receive the S13 address that is encoded in the signature confirmation signal originating from the perforating gun 28h. The processor 28d1 of the perforating gun controller board 28d will attempt to find a match between the S13 address in the confirmation signal and the addresses stored in memory 28d3. The processor 28d1 will find a match between the incoming S13 address in the confirmation signal on bus 28g with an address S13 stored in memory 28d3. As a result, when the match is found, an S14 instruction, which corresponds to the S13 address in memory 28d3, will be read from the memory 28d3 by processor 28d1. The processor 28d1 of the perforating gun controller board 28d of FIGS. 5 and 9 will direct the S14 instruction (which is a digital signal) to the acoustic telemetry interface board 28b, where the interface board 28b will convert the incoming digital S14 instruction signal into an analog S14 instruction signal which represents the digital S14 instruction and has encoded therein an S14 address. The analog S14 instruction signal will propagate along bus 28c to the acoustic receiver transmitter (acoustic R/T) 28a, where the acoustic R/T 28a will convert the incoming analog S14 instruction signal from bus 28c into acoustic signals, the acoustic signals representing the analog S14 instruction signal and having encoded therein the same S14 address. The acoustic signals propagate along the acoustic data bus 36 in FIGS. 3 through 5 and 7 through 9 and are received in the acoustic R/T's of all of the other wellbore tools of the multiple wellbore tool apparatus 14 of FIGS. 1 and 6.

In FIGS. 3 through 5 and 7 through 9, the acoustic signals having the S14 address propagate along the acoustic data bus 36 and are received in the acoustic R/T 26a, 20a, 18a, and 24a of the valve module 26, the flowmeter module 20, the packer module 18, and the recorder module 24 of the multiple wellbore tool apparatus 14 of FIGS. 1 and 6. These acoustic R/Ts will convert the incoming acoustic signals (having the S14 address) into corresponding electrical analog signals also having the S14 address encoded therein. The acoustic telemetry interface boards 26b, 20b, 18b, and 24b convert their corresponding incoming electrical analog signals having the S14 address into corresponding digital signals also having the S14 address encoded therein, and these digital signals, having the S14 address, propagate along the buses 26e, 20e, 18e, and 24e to the controller boards 26d, 20d, 18d, and 24d of the valve module 26, the flowmeter module 20, the packer module 18, and the recorder module 24 of FIGS. 3 through 5 and 7 through 9.

An examination of the memories of the controller boards 26d, 20d, 18d, and 24d of the valve module, the flowmeter module, the packer module, and the recorder module in FIGS. 10–13 will reveal that the memory 24d3 of the recorder controller board 24d of the recorder module is the only memory in which an S14 address is encoded.

Accordingly, when the digital signal having the S14 address is received from the recorder acoustic telemetry interface board 24b of FIGS. 4 and 8 via the buses 24e and into the recorder controller board 24d of FIGS. 4 and 8, the processor 24d1 of the recorder controller board 24d in FIG. 13 will determine that there is a match between the incoming S14 address in the digital signal from bus 24e and the S14 address stored in memory 24d3 of the recorder controller board 24d. As a result, when the match is found, the processor 24d1 of the recorder controller board 24d will begin executing a set of instructions stored in memory 24d3 which correspond to the S14 address, the set of instructions being known as the "I7 Subroutine". When the recorder processor 24d1 begins to execute the I7 subroutine, the recorder processor 24d1 of FIG. 13 will begin reading and executing each individual instruction which comprises the I7 subroutine. A flowchart of the I7 subroutine is illustrated in FIG. 15.

In the I7 Subroutine flowchart of FIG. 15, the processor 24d1 of the recorder controller board 24d reads the first instruction of the I7 subroutine from memory 24d3. When the first instruction is executed, the processor 24d1 transmits an I7 instruction to the recorder sensors 24h of FIGS. 4 and 8, block 24d3A of FIG. 15. In response, the recorder sensors 24h will transmit and the processor 24d1 of the recorder controller board 24d will receive a first pressure measurement relating to the pressure of the wellbore fluid flowing within the multiple wellbore tool apparatus 14 of FIGS. 1 and 6, block 24d3B of FIG. 15. The processor 24d1 of the recorder controller board 24d determines if the first pressure measurement is greater than or equal to a preset, predetermined value. If yes, the processor 24d1 transmits an S15 signature address signal onto the system bus 24d2 to interrogate the memory 24d3 of FIG. 13, block 24d3D of FIG. 15. If no, the processor 24d1 of the recorder controller board 24d will receive a subsequent pressure measurement from recorder sensors 24h, at which time, it will determine if the subsequent pressure measurement is equal to or greater than a preset value. If yes, the processor 24d1 will transmit the S15 signature address signal onto the system bus 24d2 to interrogate the memory 24d3 of FIG. 13. This process will repeat until the first received pressure measurement received by the processor 24d1 from the recorder sensors 24h is equal to or greater than the preset value, at which time, the S15 signature address signal will be transmitted by processor 24d1 onto the system bus 24d2 to interrogate the memory 24d3 of FIG. 13.

The S15 address of the S15 signature address signal will match an S15 address stored in memory 24d3 of the recorder controller board 24d. As a result, an S16 instruction will be read from the memory 24d3 of the recorder controller board 24d of FIG. 13.

8. Determine if the flowrate from the flowmeter sensors 20 is greater than or equal to a preset, predetermined value, block 53.

The processor 24d1 of the recorder controller board 24d of FIGS. 4, 8, and 13 will direct the S16 instruction (which is a digital signal) to the acoustic telemetry interface board 24b, where the interface board 24b will convert the incoming digital S16 instruction signal into an analog S16 instruction signal which represents the digital S16 instruction and has encoded therein an S16 address. The analog S16 instruction signal will propagate along bus 24c to the acoustic receiver transmitter (acoustic R/T) 24a, where the acoustic R/T 24a will convert the incoming analog S16 instruction signal from bus 24c into acoustic signals, the acoustic signals representing the analog S16 instruction signal and having encoded therein the same S16 address. The acoustic signals propagate along the acoustic data bus 36 in FIGS. 3 through 5 and 7 through 9 and are received in the acoustic R/T's of all of the other wellbore tools of the multiple wellbore tool apparatus 14 of FIGS. 1 and 6.

In FIGS. 3 through 5, 7 through 9, and 13, the acoustic signals having the S16 address propagate along the acoustic data bus 36 and are received in the acoustic R/T 26a, 20a, 18a, and 28a of the valve module 26, the flowmeter module 20, the packer module 18, and the perforating gun module 28 of the multiple wellbore tool apparatus 14 of FIGS. 1 and 6. These acoustic R/Ts will convert the incoming acoustic signals (having the S16 address) into corresponding electrical analog signals also having the S16 address encoded therein. The acoustic telemetry interface boards 26*b*, 20*b*, 18*b*, and 28*b* convert their corresponding incoming electrical analog signals having the S16 address into corresponding digital signals also having the S16 address encoded therein, and these digital signals, having the S16 address, propagate along the buses 26*e*, 20*e*, 18*e*, and 28*e* to the controller boards 26*d*, 20*d*, 18*d*, and 28*d* of the valve module 26, the flowmeter module 20, the packer module 18, and the perforating gun module 28 of FIGS. 3 through 5 and 7 through 9.

An examination of the memories of the controller boards 26*d*, 20*d*, 18*d*, and 28*d* of the valve module, the flowmeter module, the packer module, and the perforating gun module in FIGS. 10 through 12 and 14 will reveal that the memory 20*d*3 of the flowmeter controller board 20*d* of FIG. 11 of the flowmeter module 20 is the only memory in which an S16 address is encoded.

Accordingly, when the digital signal having the S16 address is received from the flowmeter acoustic telemetry interface board 20*b* of FIGS. 3 and 7 via the buses 20*e* and into the flowmeter controller board 20*d* of FIGS. 3 and 7, the processor 20*d*1 of the flowmeter controller board 20*d* in FIGS. 3 and 7 will determine that there is a match between the incoming S16 address in the digital signal from bus 20*e* and the S16 address stored in memory 20*d*3 of the flowmeter controller board 20*d* of FIG. 11. As a result, when the match is found, the processor 20*d*1 of the flowmeter controller board 20*d* will begin executing a set of instructions stored in memory 20*d*3 which correspond to the S16 address, the set of instructions being known as the "I8 Subroutine". When the flowmeter processor 20*d*1 of FIG. 11 begins to execute the I8 subroutine, the flowmeter processor 20*d*1 of FIG. 11 will begin reading and executing each individual instruction which comprises the 18 subroutine. A flowchart of the I8 subroutine is illustrated in FIG. 16.

In the I8 Subroutine flowchart of FIG. 16, the processor 20*d*1 of the flowmeter controller board 20*d* reads the first instruction of the I8 subroutine from memory 20*d*3. When the first instruction is executed, the processor 20*d*1 transmits an I8 instruction to the flowmeter sensors 20*h* of FIGS. 3 and 7, block 20*d*3A of FIG. 16. In response, the flowmeter sensors 20*h* will transmit and the processor 20*d*1 of the flowmeter controller board 20*d* will receive a first flowrate measurement relating to the flowrate of the wellbore fluid flowing within the multiple wellbore tool apparatus 14 of FIGS. 1 and 6, block 20*d*3B of FIG. 16. The processor 20*d*1 of the flowmeter controller board 20*d* determines if the first flowrate measurement is greater than or equal to a preset, predetermined value. If yes, the processor 20*d*1 transmits an S17 signature address signal onto the system bus 20d2 to interrogate the memory 20*d*3 of FIG. 11, block 20*d*3D of FIG. 16. If no, the processor 20*d*1 of the flowmeter controller board 20*d* will receive a subsequent flowrate measurement from flowmeter sensors 20*h*, at which time, it will determine if the subsequent flowrate measurement is equal to or greater than a preset value. If yes, the processor 20*d*1 will transmit the S17 signature address signal onto the system bus 20*d*2 to interrogate the memory 20*d*3 of FIG. 11. This process will repeat until the first received flowrate measurement received by the processor 20*d*1 from the flowmeter sensors 20*h* is equal to or greater than the preset value, at which time, the S17 signature address signal will be transmitted by processor 20*d*1 onto the system bus 20*d*2 to interrogate the memory 20*d*3 of FIG. 11.

The S17 address encoded into the S17 signature address signal will match an S17 address stored in memory 20*d*3 of the flowmeter controller board 20*d* in FIG. 11. As a result, an S18 instruction will be read from the memory 20*d*3 of the flowmeter controller board 20*d*.

9. When the pressure reading from the recorder sensors 24 and the flowrate reading from the flowmeter sensors 20 is greater than or equal to a preset, predetermined value, close the test valve 26, block 54.

The processor 20*d*1 of the flowmeter controller board 20*d* of FIGS. 3 and 7 will direct the S18 instruction (which is a digital signal) to the acoustic telemetry interface board 20*b*, where the interface board 20*b* will convert the incoming digital S18 instruction signal into an analog S18 instruction signal which represents the digital S18 instruction and has encoded therein an S18 address. The analog S18 instruction signal will propagate along bus 20*c* to the acoustic receiver transmitter (acoustic R/T) 20*a*, where the acoustic R/T 20*a* will convert the incoming analog S18 instruction signal from bus 20*c* into acoustic signals, the acoustic signals representing the analog S18 instruction signal and having encoded therein the same S18 address. The acoustic signals propagate along the acoustic data bus 36 in FIGS. 3 through 5 and 7 through 9 and are received in the acoustic R/T's of all of the other wellbore tools of the multiple wellbore tool apparatus 14 of FIGS. 1 and 6.

In FIGS. 3 through 5, 7 through 9 and 10, the acoustic signals having the S18 address propagate along the acoustic data bus 36 of FIGS. 3 through 5 and 7 through 9 and are received in the acoustic R/T 26*a*, 18*a*, 24*a*, and 28*a* of the valve module 26, the packer module 18, the recorder module 24 and the perforating gun module 28 of the multiple wellbore tool apparatus 14 of FIGS. 1 and 6. These acoustic R/Ts will convert the incoming acoustic signal (having the S18 address) into corresponding electrical analog signals also having the S18 address encoded therein. The acoustic telemetry interface boards 26*b*, 18*b*, 24*b*, and 28*b* convert their corresponding incoming electrical analog signals having the S18 address into corresponding digital signals also having the S18 address encoded therein, and these digital signals, having the S18 address, propagate along the buses 26*e*, 18*e*, 24*e*, and 28*e* to the controller boards 26*d*, 18*d*, 24*d*, and 28*d* of the valve module 26, the packer module 18, the recorder module 24, and the perforating gun module 28 of FIGS. 3 through 5 and 7 through 9.

An examination of the memories of the controller boards 26*d*, 18*d*, 24*d*, and 28*d* in FIGS. 10 and 12–14 will reveal that the memory 26*d*3 of the valve controller board 26*d* of FIG. 10 is the only memory in which an S18 address is encoded.

Accordingly, when the digital signal having the S18 address is received from the valve acoustic telemetry interface board 26*b* of FIGS. 3 and 7 via the bus 26*e* and into the valve controller board 26*d* of FIG. 10, the processor 26*d*1 in FIG. 10 will determine that there is a match between the S18 address in the digital signal from bus 26*e* and the S18 address stored in memory 26*d*3 of the valve controller board 26*d*.

As a result, in response to receipt of the digital signal from bus 26*e* having the S18 address, a digital 19 instruction which corresponds to the S18 address in memory 26*d*3 will be read from memory 26*d*3 by processor 26*d* 1 of the valve module 26 of FIG. 10.

The processor 26*d*1 of the valve controller board 26*d* will direct the I9 instruction, via its digital electronics, to the driver board 26*f* in FIGS. 3 and 7 via bus 26*g*. The driver board 26f (which includes the electrohydraulic mechanism) receives the I9 instruction from the valve controller board 26d and, in response thereto, provides the necessary hydraulic force necessary to close the test valve 26h.

Actual Construction of Wellbore Tools

Referring to FIGS. 18 through 23, recall from the above discussion that each of the individual wellbore tools (e.g., the valve wellbore tool, the flowmeter wellbore tool, the packer wellbore tool, etc) of the multiple wellbore tool apparatus of FIGS. 1 and 6 includes a first common controller transducer part (e.g., the command sensor, the receiver board, the controller, the power supply, the battery, the acoustic telemetry interface board, and the acoustic R/T) and a second unique part (e.g., for the valve, the driver board 26f and the valve 26h) connected to the first part.

In FIGS. 18–23, a construction of the first common controller transducer part 60 and the second unique part (one of 62, 64, 66, 68, 70) of each wellbore tool of the multiple wellbore tool apparatus of FIGS. 3–5 or FIGS. 7–9 is illustrated.

Figure 25:
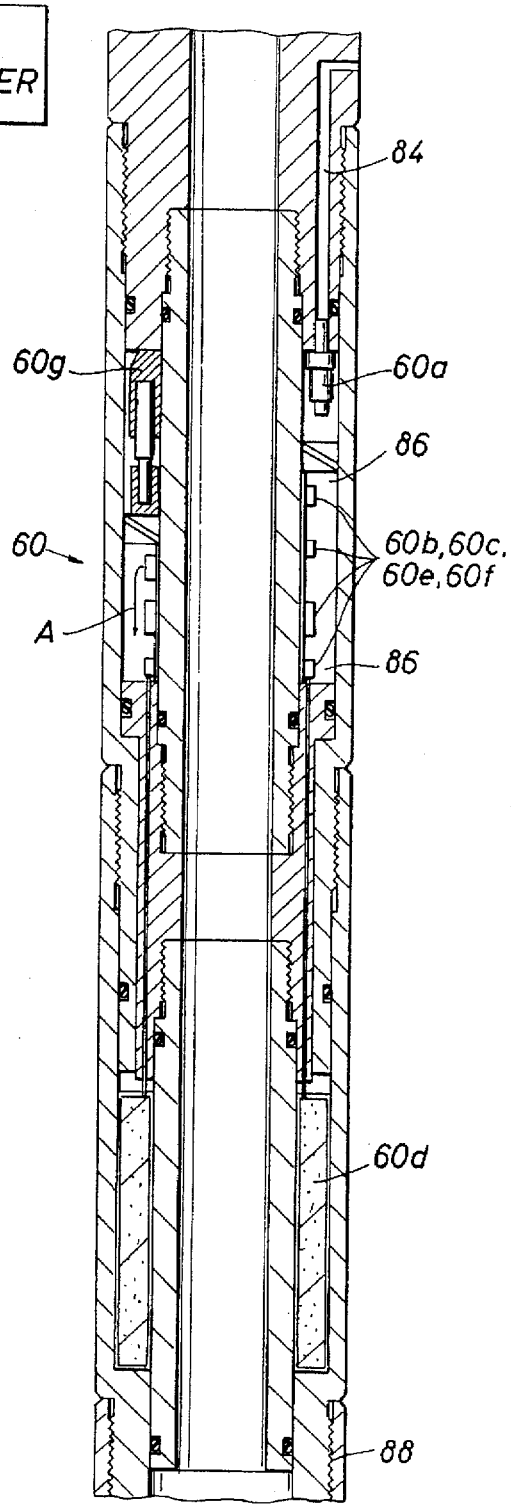
FIG. 25 illustrates an actual construction of the first part of each wellbore tool shown in FIG. 18 which is adapted to be connected to each of the second parts shown in FIGS. 19–23.

The first controller transducer part 60 of each wellbore tool is shown again, as an actual construction, in FIG. 25, and the second parts 62, 64, 66, 68, and 70 of each wellbore tool are shown again, as an actual construction, in FIGS. 26 through 31.

Figure 18:
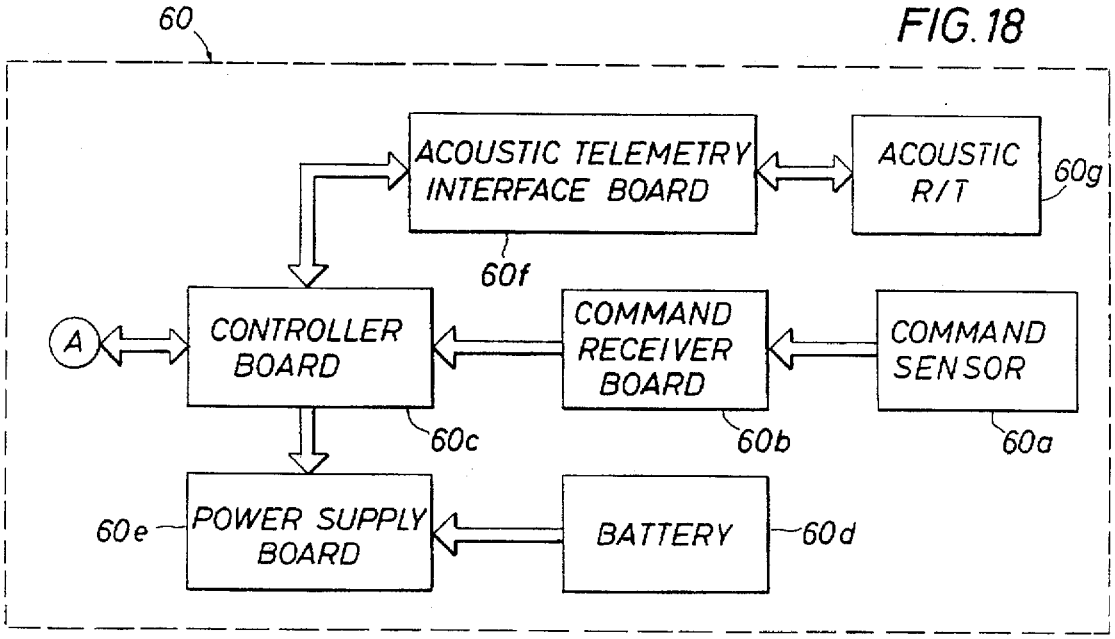
FIG. 18 illustrates a construction of a first part of each wellbore tool of the multiple wellbore tool apparatus of FIGS. 3–5 or FIGS. 7–9, the first part of each wellbore tool being shown again, as an actual construction, in FIG. 25.

In FIG. 18, each wellbore tool of FIGS. 3–5 and 7–9 includes a first controller transducer part 60 and, in FIGS. 19–23, a second part (one of 62, 64, 66, 68, 70 in FIGS. 19–23) is connected to the first part 60. The first controller transducer part 60 is common to each wellbore tool in FIGS. 3–5, 7–9 and is used in each wellbore tool; however, the second part, used in each wellbore tool, is unique to that particular wellbore tool.

For example, in FIG. 18, each wellbore tool of FIGS. 3–5, 7–9 includes a first controller transducer part 60 which consists of the following individual components, as described above with reference to FIGS. 3–5 and 7–9: a command sensor 60a, a command receiver board 60b connected to the command sensor 60a, a controller board 60c connected to the command receiver board 60b, a power supply 60e and battery 60d connected to and powering the controller board 60c, an acoustic telemetry interface board 60f, and an acoustic R/T 60g connected to the controller board 60c. The first controller transducer part 60 of FIG. 18 is common to and is used in each wellbore tool of the multiple wellbore tool apparatus of FIGS. 1 and 6.

However, in FIG. 19 through 23, each individual wellbore tool of FIGS. 1, 3–5 and 6, 7–9 includes a unique second part (one of second parts 62, 64, 66, 68, and 70 in FIGS. 19–23) which is unique to that particular wellbore tool, the second part for a particular wellbore tool being connected to an output "A" of the controller board of the first controller transducer part 60 of FIG. 18.

Figure 19:
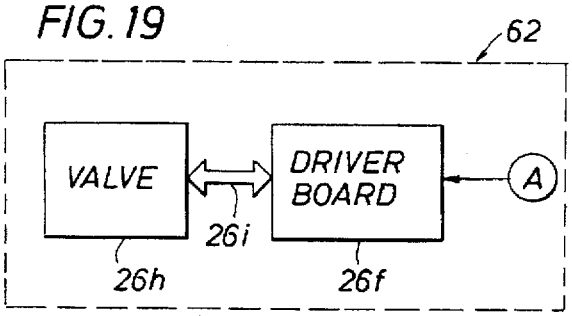
FIG. 19 illustrates a construction of a second part of the valve wellbore tool of FIGS. 3 and 7 which is used in conjunction with the first part of FIG. 18, the second part of the valve wellbore tool of FIG. 19 being shown again as an actual construction in FIG. 26.

For example, a second part 62 in FIG. 19 of the valve wellbore tool of FIGS. 3 and 7 includes the driver board 26f and the valve 26h which is connected to the output "A" of the first controller transducer part 60 of FIG. 18.

Figure 20:
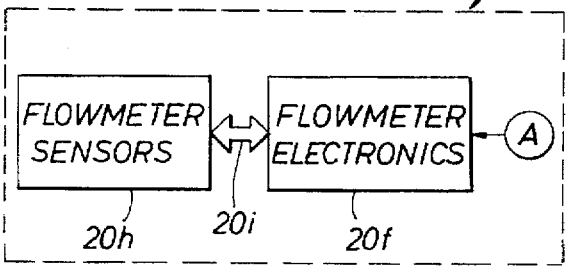
FIG. 20 illustrates a construction of a second part of the flowmeter wellbore tool of FIGS. 3 and 7 which is used in conjunction with the first part of FIG. 18, the second part of the flowmeter wellbore tool of FIG. 20 being shown again as an actual construction in FIG. 27.

The second part 64 in FIG. 20 of the flowmeter wellbore tool of FIGS. 3 and 7 includes the flowmeter electronics 20f and the flowmeter sensors 20h which is connected to the output "A" of the first controller transducer part 60 of FIG. 18.

Figure 21:
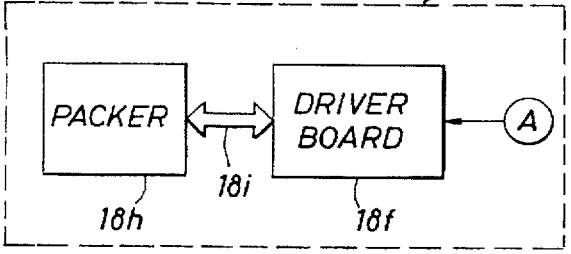
FIG. 21 illustrates a construction of a second part of the packer wellbore tool of FIGS. 4 and 8 which is used in conjunction with the first part of FIG. 18, the second part of the packer wellbore tool of FIG. 21 being shown again as an actual construction in FIGS. 28 and 29.

The second part 66 in FIG. 21 of the packer wellbore tool of FIGS. 4 and 8 includes the driver board 18f and the packer 18h which is connected to the output "A" of the first controller transducer part 60 of FIG. 18.

Figure 22:
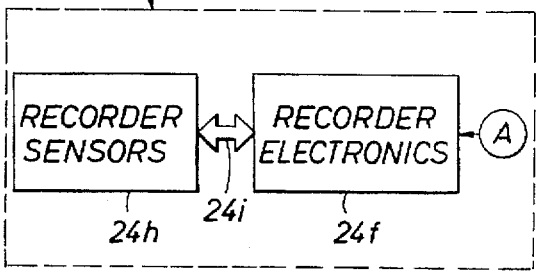
FIG. 22 illustrates a construction of a second part of the recorder wellbore tool of FIGS. 4 and 8 which is used in conjunction with the first part of FIG. 18, the second part of the recorder wellbore tool of FIG. 22 being shown again as an actual construction in FIG. 30.

The second part 68 in FIG. 22 of the recorder wellbore tool of FIGS. 4 and 8 includes the recorder electronics 24f and the recorder sensors 24h which is connected to the output "A" of the first controller transducer part 60 of FIG. 18.

Figure 23:
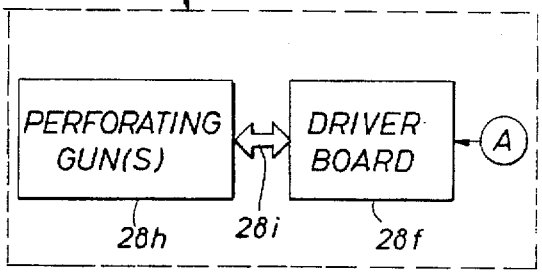
FIG. 23 illustrates a construction of a second part of the perforating gun wellbore tool of FIGS. 5 and 9 which is used in conjunction with the first part of FIG. 18, the second part of the perforating gun wellbore tool of FIG. 23 being shown again as an actual construction in FIGS. 31A and 31B.

Lastly, the second part 70 in FIG. 23 of the perforating gun wellbore tool of FIGS. 5 and 9 includes the driver board 28f and the perforating guns 28h which is connected to the output "A" of the first controller transducer part 60 of FIG. 18.

Figure 24:
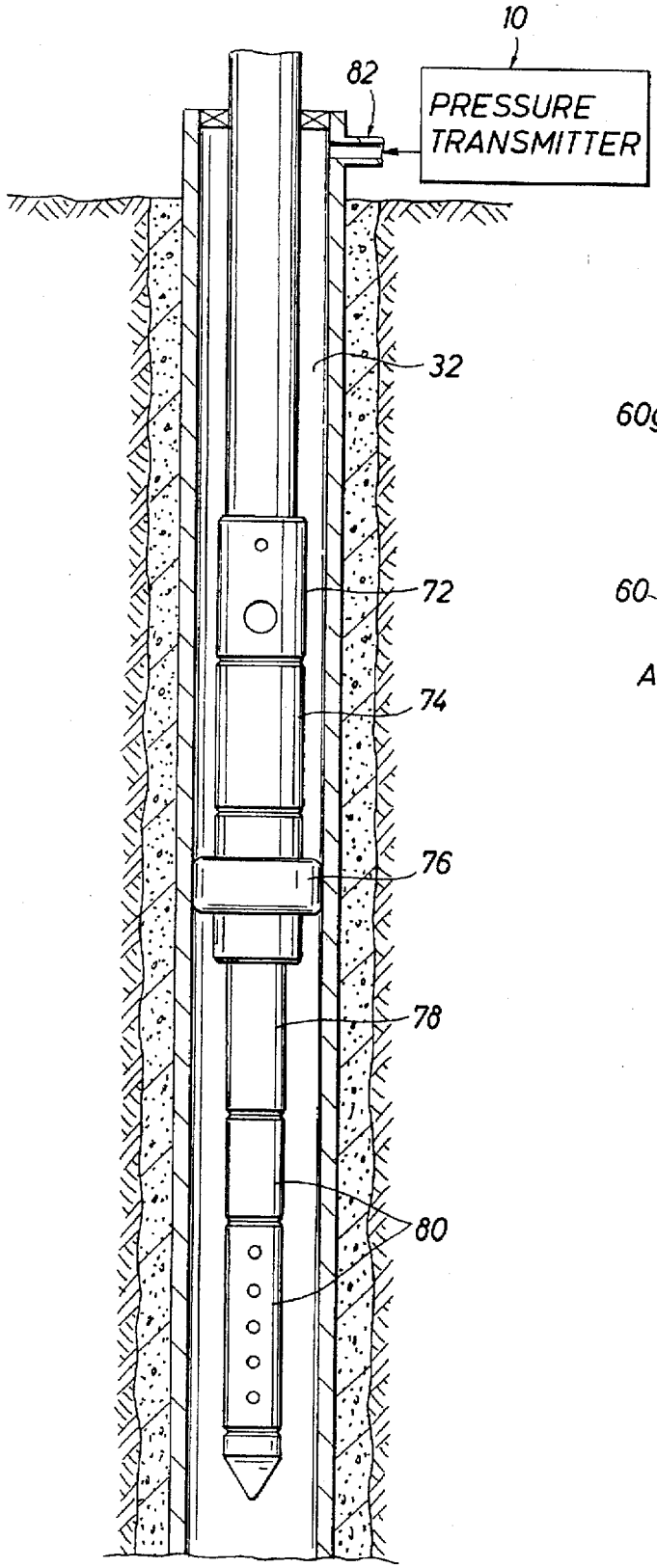
FIG. 24 illustrates a tool string disposed in a wellbore representing the multiple wellbore tool apparatus of FIGS. 1 or 6 and including the plurality of wellbore tools which further include a valve, a flowmeter, a packer, a recorder, and a perforating gun.

Referring to FIG. 24, a tool string is disposed in a wellbore and represents the multiple wellbore tool apparatus of FIGS. 1 or 6, the tool string of FIG. 24 including the plurality of wellbore tools, the plurality of wellbore tools further including a valve 72, a flowmeter 74, a packer 76, a recorder 78, and a perforating gun (which includes a firing head and the gun itself) 80. A pressure transmitter 10, disposed at a surface of the wellbore, transmits an input stimulus in the form of one or more pressure pulses having a predetermined signature into the annulus region 32, which is filled with a wellbore fluid, via a fluid line 82, and the input stimulus propagates along the path of travel 34 of FIG. 1, performing the functions stated above in connection with FIGS. 1 through 17 of the drawings.

In FIG. 24, each of the plurality of wellbore tools includes the first controller transducer part 60 and a second part (one of 62, 64, 66, 68, or 70). For example, the valve 72 of FIG. 24 includes the first part 60 (of FIG. 18) and the second part 62 (of FIG. 19) connected to the first part 60. The flowmeter 74 of FIG. 24 includes the first part 60 (of FIG. 18) and the second part 64 (of FIG. 20) connected to the first part 60. The packer 76 of FIG. 24 includes the first part 60 (of FIG. 18) and the second part 66 (of FIG. 21) connected to the first part 60. The recorder 78 of FIG. 24 includes the first part 60 (of FIG. 18) and the second part 68 (of FIG. 22) connected to the first part 60. Lastly, the perforating gun 80 of FIG. 24 includes the first part 60 (of FIG. 18) and the second part 70 (of FIG. 23) connected to the first part 60.

Referring to FIG. 25, an actual construction of the first controller transducer part 60 of FIG. 18 is illustrated.

In FIG. 18, the first controller transducer part 60 is shown in block diagram form; in addition, the first controller transducer part 60 of FIG. 18 is also shown in FIGS. 3–5 and 7–9 of the drawings connected to the second part, and it is discussed above, in the functional description, with reference to FIGS. 3–5 and 7–9 of the drawings. However, FIG. 25 represents a more realistic, actual construction of the first controller transducer part 60 shown in FIG. 18.

In FIG. 25 with further reference to FIG. 18, the first controller transducer part 60 includes the command sensor 60a fluidly connected to the annulus region 32 of the wellbore of FIG. 24 via a fluid channel 84, the acoustic R/T 60g, and an annular battery 60d. The remaining components of FIG. 18, namely the command receiver board 60b, the controller board 60c, the power supply board 60e, and the acoustic telemetry interface board 60f, are shown in FIG. 25 as being located within an interior space 86 of the first controller transducer part 60. An end 88 of the first controller transducer part 60 is threaded, at 88, so that the first controller transducer part 60 in FIG. 25 may be threadedly connected to one of the second parts 62, 64, 66, 68, or 70 in FIGS. 19–23.

Figure 26:
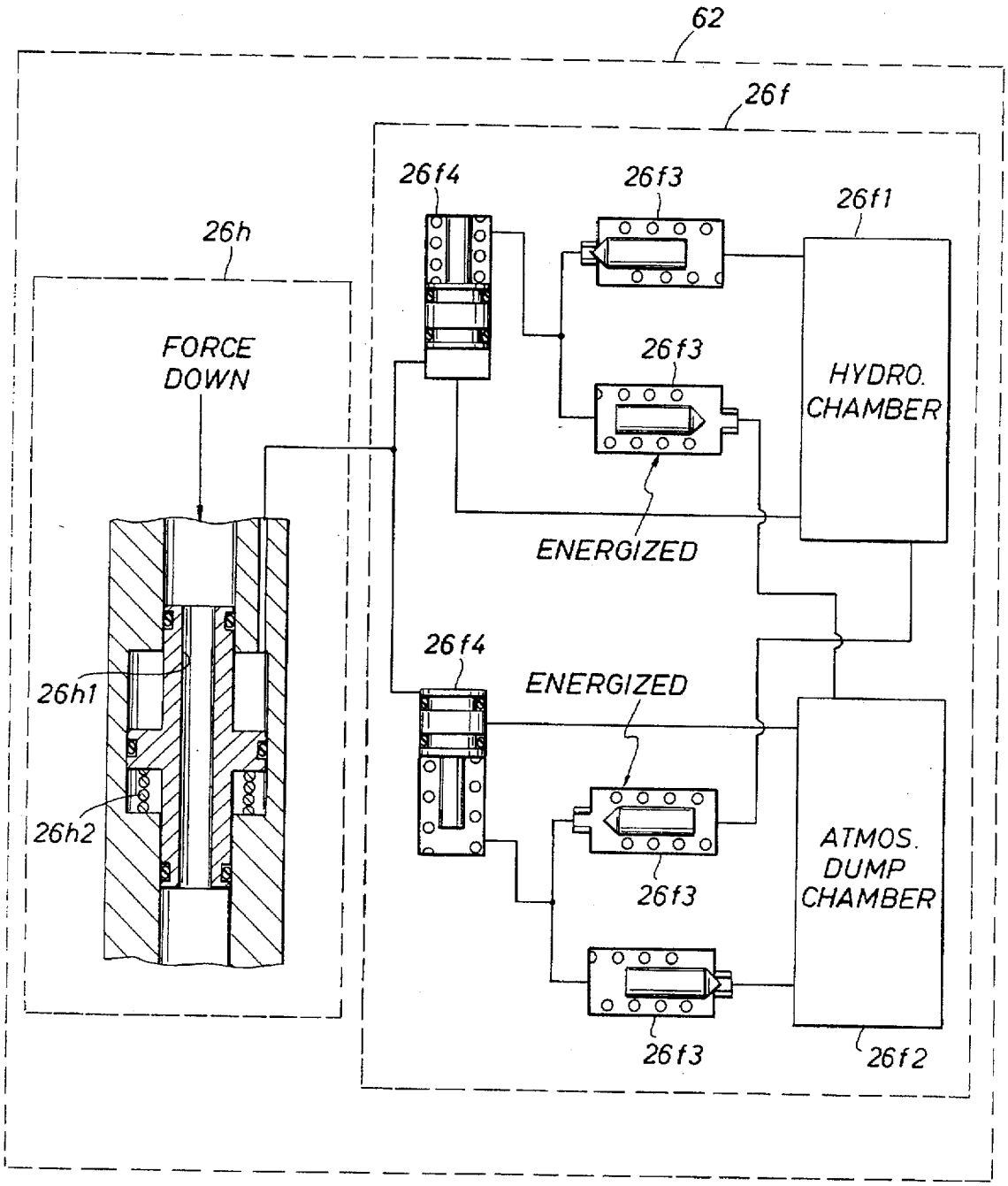
FIG. 26 illustrates an actual construction of the second part of the valve wellbore tool shown in FIG. 19 which is adapted to be connected to the first part, connectable to each wellbore tool, shown in FIG. 25.

Referring to FIG. 26, an actual construction of the second part 62 in FIG. 19 of the valve wellbore tool of FIGS. 3 and 7 is illustrated.

In FIG. 26, the second part 62 of the valve wellbore tool (which is connected to the first controller transducer part 60 of FIGS. 18 and 25) includes the driver board 26*f* and the valve 26*h*, the second part 62 being connected to the output "A" of the first controller transducer part 60 of FIGS. 18 and 25. The driver board 26*f* includes a hydro chamber 26*f*1 and a dump chamber 26*f*2 connected to a set of solenoids 26*f*3 (four in number). The solenoids 26*f*3 are further connected to a pair of pilot valves 26*f*4. The valve 26*h* includes a piston 26*h*1 which is biased upwardly by a spring 26*h*2, the piston 26*h*1 moving downwardly against the biasing force of the spring 26*h*2, thereby opening or closing the valve 26*h*, when its pilot valve 26*f*4 is operated in response to operation of its solenoid 26*f*3 by an output signal from the controller board 60*c* in FIG. 18. This second part 62 of the valve wellbore tool is fully described in detail in U.S. Pat. No. 4,896,722 to Upchurch, the disclosure of the Upchurch patent being incorporated by reference into this specification.

Figure 27:
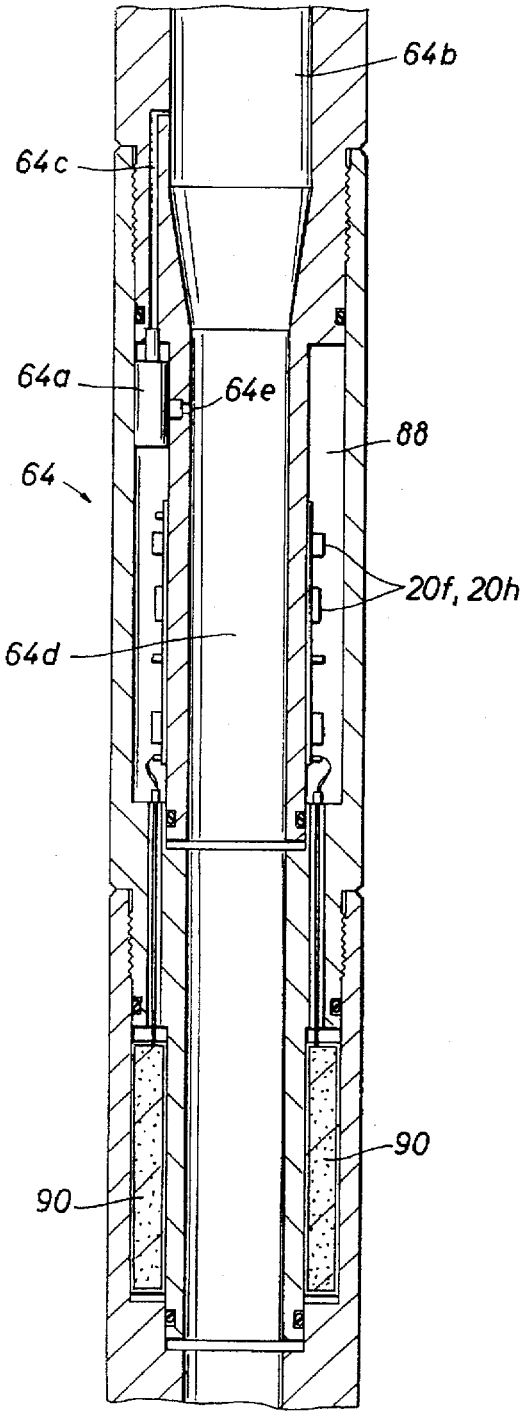
FIG. 27 illustrates an actual construction of the second part of the flowmeter wellbore tool shown in FIG. 20 which is adapted to be connected to the first part, connectable to each wellbore tool, shown in FIG. 25.

Referring to FIG. 27, an actual construction of the second part 64 in FIG. 20 of the flowmeter wellbore tool of FIGS. 3 and 7 is illustrated.

In FIG. 27, an actual construction of the second part 64 (in FIG. 20) of the flowmeter wellbore tool of FIGS. 3 and 7 is illustrated. The second part 64 of the flowmeter wellbore tool (which is connected to the first controller transducer part 60 of FIGS. 18 and 25) includes a flowmeter transducer 64*a* which senses the pressure of a wellbore fluid flowing within a first central bore 64*b*. The transducer 64*a* is fluidly connected to the first central bore 64*b* via a first fluid channel 64*c*. In addition, the flowmeter transducer 64*a* also senses the pressure of the wellbore fluid flowing within a second central bore 64*d*, the diameter of the second central bore 64*d* being less than the diameter of the first central bore 64*b*. The transducer 64*a* is also fluidly connected to the second central bore 64*d* via a second fluid channel 64*e*. A flowmeter which is similar to that shown in FIG. 27 may be found in U.S. Pat. No. 5,174,161 to Veneruso et al, entitled "Wireline and Coiled Tubing Retrievable Choke for Downhole Flow Measurement", the disclosure of which is incorporated by reference into this specification.

In operation, the wellbore fluid, flowing in the first central bore 64*b*, flows into the first fluid channel 64*c* and the flowmeter transducer 64*a* senses the pressure of the wellbore fluid flowing in the first central bore 64*b* and received in the first fluid channel 64*c*. In addition, the wellbore fluid, flowing in the second central bore 64*d*, flows into the second fluid channel 64*e* and the flowmeter transducer 64*a* senses the pressure of the wellbore fluid flowing in the second central bore 64*d* and received in the second fluid channel 64*e*. A differential pressure (the difference between the wellbore fluid pressure existing in the first fluid channel 64*c* and the second fluid channel 64*e*) is measured by the flowmeter transducer 64*a*, and the flowmeter transducer 64*a* generates a differential pressure output signal representative of the aforementioned differential pressure. That differential pressure reading inherent in the differential pressure output signal from the flowmeter transducer 64*a* is translatable into a flowrate figure.

Recall from FIG. 20 that the second part 64 of the flowmeter wellbore tool includes the flowmeter electronics 20*f* and the flowmeter sensors 20*h*. In FIG. 27, the flowmeter electronics 20*f* and the flowmeter sensors 20*h* are disposed within an annular space 88 within the second part 64 of the flowmeter wellbore tool. The flowmeter electronics 20*f* and flowmeter sensors 20*h* are powered by an annular battery 90 also disposed within an annular space. The flowmeter electronics 20*f* in annular space 88 receive the differential pressure output signal from the flowmeter transducer 64*a*.

In response to the I5 instruction from the processor 20*d*1 of the flowmeter controller board 20*d*, the flowmeter electronics 20*f* and the flowmeter sensors 20*h* in the annular space 88 of FIG. 27 will be enabled. Then, when the I8 subroutine of FIG. 16 is subsequently executed by the flowmeter processor 20*d*1 of FIG. 11 and the I8 instruction signal is generated from the processor 20*d*1 (FIG. 11) of the flowmeter controller board 20*d* of FIG. 11 (or from the controller board 60*c* in FIG. 18), the flowmeter electronics 20*f* and the flowmeter sensors 20*h* will respond to the I8 instruction signal by translating the differential pressure reading in the differential pressure output signal from the flowmeter transducer 64*a* into a flowrate figure. The flowmeter sensors 20*h* of the second part 64 in annular space 88 of FIG. 27 will then transmit that flowrate figure back to the processor 20*d*1 (FIG. 11) of the flowmeter controller board 20*d* (60*c* in FIG. 18) in the first controller transducer part 60 of FIG. 18 and 25. The remaining part of the 18 subroutine of FIG. 16 will be executed.

Figure 28:
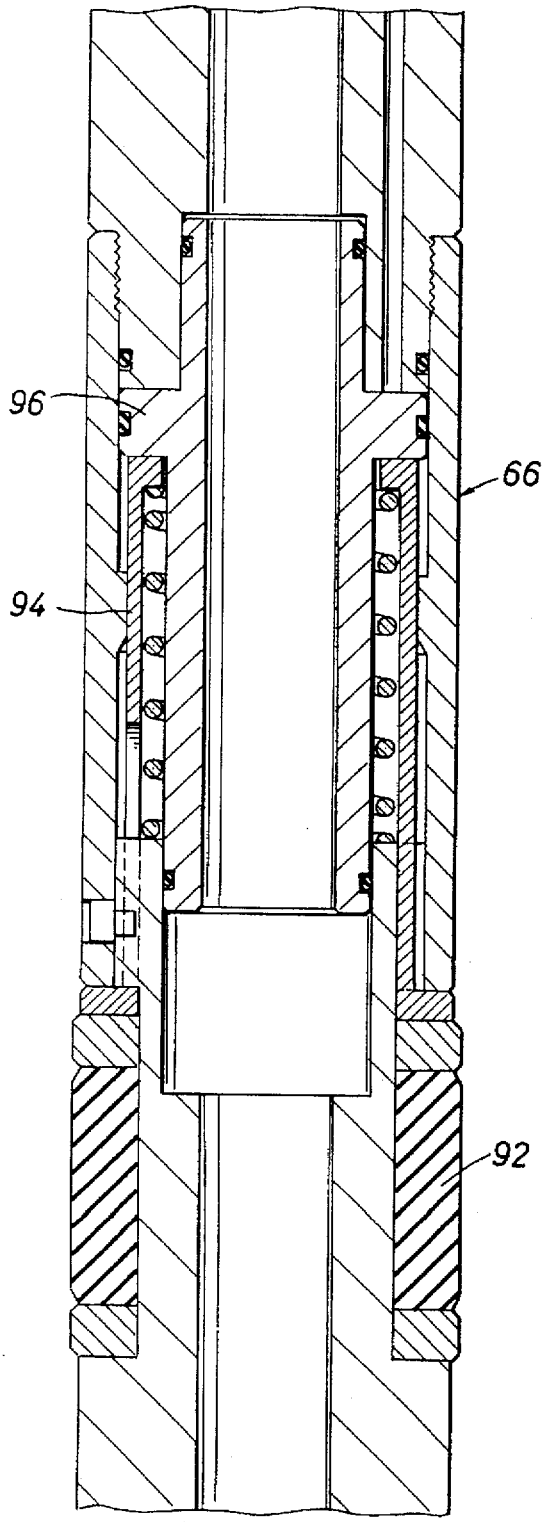
FIGS. 28 and 29 illustrate an actual construction of the second part of the packer wellbore tool shown in FIG. 21 which is adapted to be connected to the first part, connectable to each wellbore tool, shown in FIG. 25.
Figure 29:
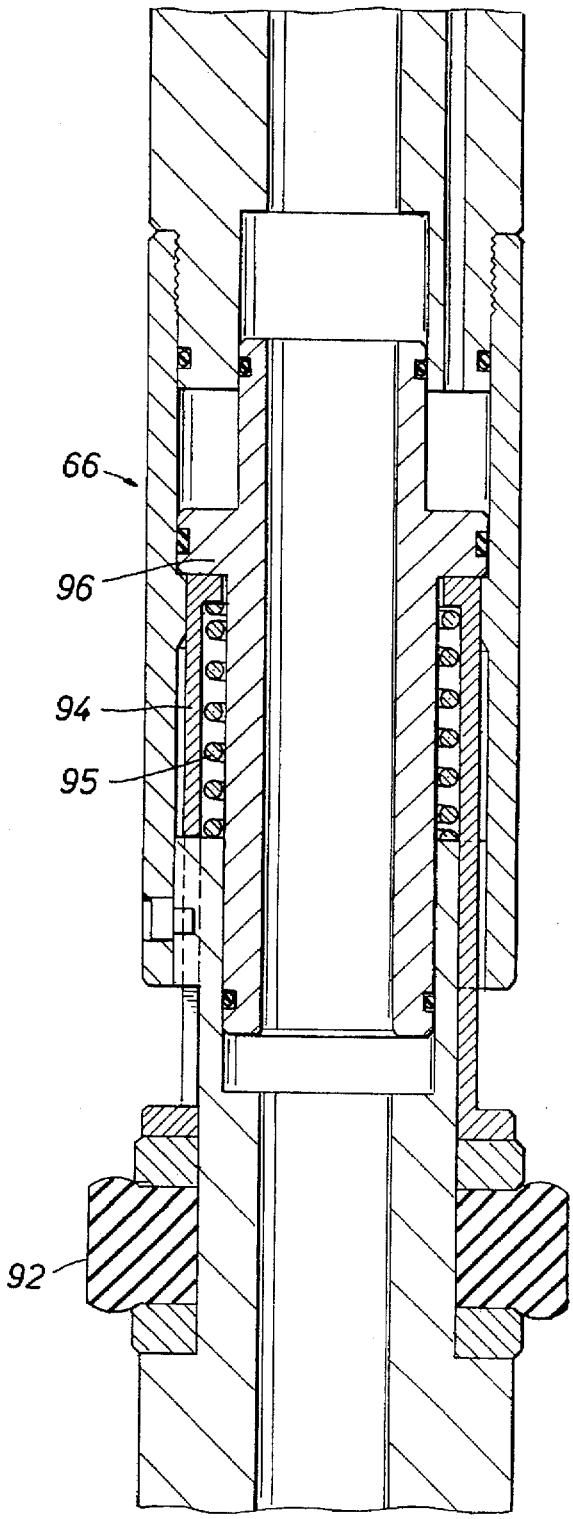

Referring to FIGS. 28 and 29, an actual construction of a portion of the second part 66 in FIG. 21 of the packer wellbore tool of FIGS. 4 and 8 is illustrated.

The second part 66, of FIG. 21, of the packer wellbore tool of FIGS. 4 and 8 (which is connected to the first controller transducer part 60 of FIGS. 18 and 25) includes a compression set packer element 92 which is compression set when a piston 94 is pushed downwardly in FIGS. 28–29 against a biasing force of a spring 95 in response to a downward movement of a mandrel 96. The mandrel 96 is moved downwardly in FIG. 29 when instructed to do so by the output signal "A" from the controller board 60*e*, which controller board 60*e* is shown in FIG. 18 and is disposed in the annular space 86 of FIG. 25. The packer controller board is also shown as packer controller board 18*d* in FIGS. 4, 8, and 12. The output signal "A" from the controller board 60*e* of FIG. 18 (or from the packer controller board 18*d* of FIGS. 4, 8, and/or 12) energizes the driver board 18*f* in FIG. 21, and the driver board 18*f* in FIG. 21 ultimately causes the mandrel 96 in FIGS. 28–29 to move downwardly which causes the piston 94 to move downwardly which sets the compression set packer element 92.

Figure 30:
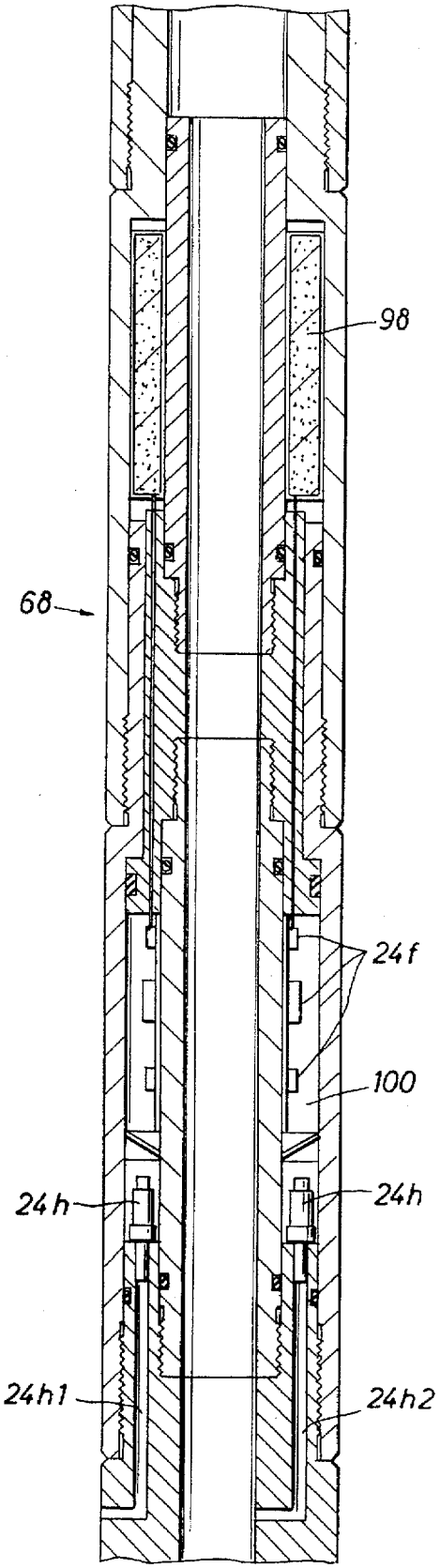
FIG. 30 illustrates an actual construction of the second part of the recorder wellbore tool shown in FIG. 22 which is adapted to be connected to the first part shown in FIG. 25.

Referring to FIG. 30, an actual construction of the second part 68 in FIG. 22 of the recorder wellbore tool of FIGS. 4 and 8 is illustrated.

The second part 68 of the recorder wellbore tool shown in FIG. 22 (which is connected to the first controller transducer part 60 of FIGS. 18 and 25) includes the recorder electronics 24*f* disposed within an annular space 100 and powered by an annular battery 98. The recorder sensors 24*h* of FIG. 22 are shown in FIG. 30 in the form of a pair of pressure transducers 24*h* which are fluidly connected to both the interior and the exterior of the second part 68 of the recorder wellbore tool in FIG. 30. For example, one pressure transducer 24*h* is fluidly connected to the exterior of the second part 68 by a fluid channel 24*h*1 and the other pressure transducer 24*h* is fluidly connected to the interior of the second part 68 by another fluid channel 24*h*2. In operation, in response to the output signal "A" from the controller board 60*c* in FIG. 18 (or from the recorder controller board 24*d* in FIGS. 4, 8, and/or 13), the recorder electronics 24*f* in FIGS. 22 or 30 will enable the recorder sensors/ pressure transducers 24*h* in FIG. 30 causing the transducers 24*h* to begin measuring the pressure of a wellbore fluid flowing both inside and outside the second part 68 of FIG. 30.

Figure 31A:
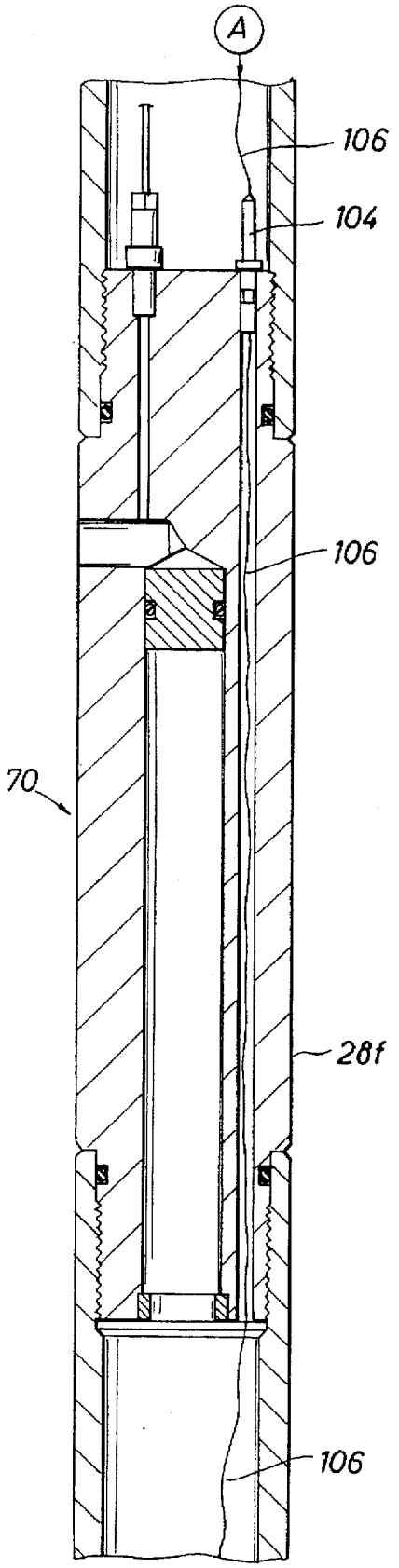
Figure 31B:
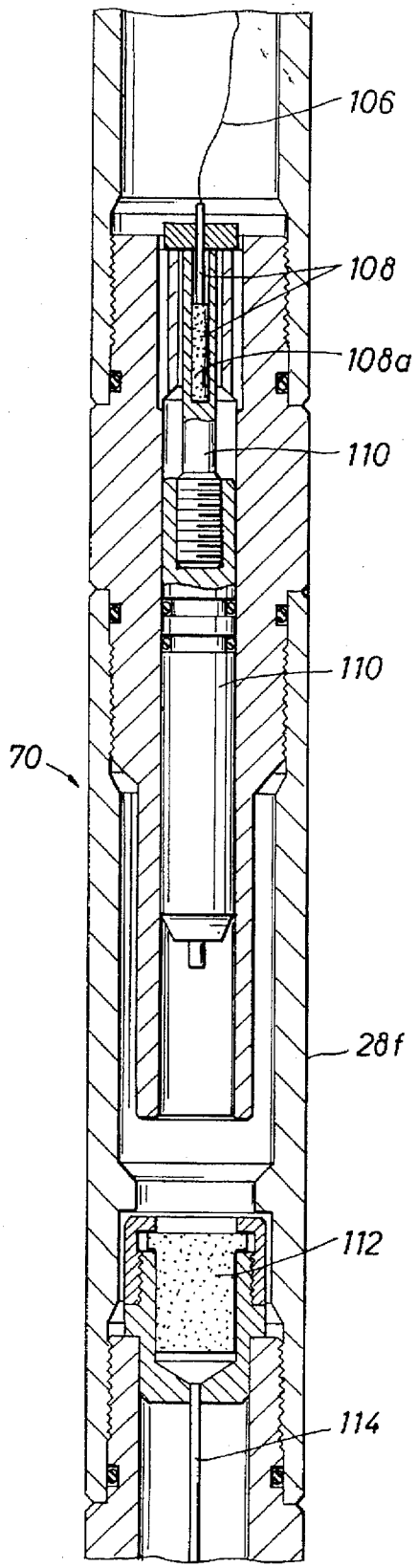

Referring to FIG. 31A and 31B, an actual construction of the second part 70 in FIG. 23 of the perforating gun wellbore tool of FIGS. 5 and 9 is illustrated.

The second part 70 of the perforating gun wellbore tool shown in FIG. 23 (which is connected to the first controller transducer part 60 of FIGS. 18 and 25) includes a driver board **28*f* (otherwise known as a firing head 28*f*) connected to the perforating guns 28*h* in FIG. 23. In FIGS. 31A and 31B, the driver board/firing head 28*f* further includes an electrical feed-thru connector 104 which holds an electrical current carrying conductor 106 and allows the conductor 106 to be electrically connected between the output terminal "A" of the controller board 60*c* of the first controller transducer part 60 in FIG. 18 (or of the perforating gun controller board 28*d* in FIGS. 5, 9, and 14) and a detonator 108 which contains an explosive 108*a*. A firing pin 110 encloses the explosive 108*a* and is shown in FIG. 31B in a raised position above a booster 112 of a detonating cord 114. In FIG. 31B, the booster 112 of the detonating cord 114 is shown below the firing pin 110. The detonating cord 114 is connected to a plurality of shaped charges of the perforating gun 28*h* in FIG. 23. In operation, when the first controller transducer part 60 of FIGS. 18 and 25 (or when the perforating gun controller board 28*d* in FIGS. 5, 9, and 14) generates an instruction signal at its output terminal "A", the instruction signal at the output terminal "A" conducts through the conductor 106 in FIG. 31A to the detonator 108 in FIG. 31B. The explosive 108*a* in the detonator 108 detonates, and, in response thereto, the firing pin 110 begins to move downwardly in FIG. 31B. Eventually, the firing pin 110 strikes the booster 112, and the impact of the firing pin 110 on the booster 112 initiates the propagation of a detonation wave in the detonating cord 114, the detonation wave detonating the plurality of shaped charges in the perforating gun 28*h***.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A wellbore tool adapted to be disposed in a fluid filled wellbore, comprising:

sensor means for sensing a stimulus propagating in the wellbore fluid and responsive thereto for generating a first output signal or a second output signal;

an included wellbore tool adapted to be operated and adapted to generate a confirmation signal having an address encoded therein indicative of at least an initiation of the operation of said included wellbore tool;

transducer means for transmitting a first acoustic signal into an acoustic data bus in response to the address encoded in said confirmation signal and receiving a second acoustic signal from said acoustic data bus; and controller means interconnected between said sensor means, said included wellbore tool, and said transducer means for operating said included wellbore tool in response to said first output signal from said sensor means.

2. The wellbore tool of claim 1, wherein said transducer means transmits said first acoustic signal into said acoustic data bus when said controller means receives said second output signal from said sensor means.

3. The wellbore tool of claim 2, wherein said controller means operates said included wellbore tool in response to said second acoustic signal received in said transducer means from said acoustic data bus.

4. A method of operating a wellbore tool adapted to be disposed in a fluid filled wellbore, said wellbore tool including a sensor adapted to respond to a stimulus propagating in the wellbore fluid, an included wellbore tool adapted to be operated and adapted to generate a confirmation signal having a signature encoded therein indicative of at least an initiation of the operation of said included wellbore tool, a transducer adapted to transmit acoustic signals into and receive acoustic signals from an acoustic data bus, and a controller interconnected between said sensor, said included wellbore tool, and said transducer adapted for operating said included wellbore tool or said transducer, said controller storing information, comprising the steps of:

propagating said stimulus in the wellbore fluid, said stimulus having a first signature;

sensing, by said sensor, said stimulus and generating an output signal having said first signature;

comparing, in said controller, said first signature of said output signal from said sensor with said information stored therein;

generating from said controller an instruction signal when said first signature corresponds to a first part of said information stored in said controller and generating from said controller a signature signal when said first signature corresponds to a second part of said information stored in said controller;

operating said included wellbore tool in response to said instruction signal from said controller and generating said confirmation signal having said signature encoded therein from said included wellbore tool; and transmitting a first acoustic signal from said transducer into said acoustic data bus in response to said signature signal from said controller or in response to said signature encoded in said confirmation signal.

5. The method of claim 4, further comprising:

receiving a second acoustic signal having a second signature from said acoustic data bus and into said transducer and generating an output signal from said transducer in response thereto, said output signal from said transducer having said second signature;

comparing, in said controller, said second signature of said output signal from said transducer with said information stored therein and generating from said controller a second instruction signal when said second signature of said output signal corresponds to a third part of said information stored in said controller; and operating said included wellbore tool in response to said second instruction signal and generating a second confirmation signal having a third signature encoded therein from said included wellbore tool indicative of at least an initiation of the operation of said included wellbore tool.

6. The method of claim 5, wherein said included wellbore tool generates said second confirmation signal having said third signature encoded therein when an operation of said included wellbore tool is complete, further comprising the steps of:

comparing, in said controller, said third signature of said second confirmation signal from said included wellbore tool with said information stored in said controller and generating from said controller a second signature signal having a fourth signature when said third signature of said second confirmation signal corresponds to a fourth part of said information stored in said controller; and transmitting from said transducer and into said acoustic data bus a third acoustic signal having said fourth signature in response to said second signature signal from said controller.

7. A multiple wellbore tool apparatus adapted to be disposed in a fluid filled wellbore, comprising:

a plurality of wellbore tools, a first one of said plurality of wellbore tools including, an input stimulus sensor adapted for sensing an input stimulus having a first signature propagating in the wellbore fluid and generating an output signal having said first signature in response thereto, an included wellbore tool adapted to be operated and adapted to generate a confirmation signal having an address encoded therein indicative of at least an initiation of the operation of said included wellbore tool;

an acoustic transducer adapted for transmitting an acoustic signal into an acoustic data bus and receiving an acoustic signal from said acoustic data bus, and controller means connected between said input stimulus sensor, said acoustic transducer, and said included wellbore tool for receiving said output signal having said first signature from said input stimulus sensor and attempting to translate said first signature of said output signal from said input stimulus sensor into either a first instruction signal or a signature signal having a second signature, said included wellbore tool being operated in response to said first instruction signal when said first signature of said output signal is translated into said first instruction signal and generating said confirmation signal having said address encoded therein in response thereto, said acoustic transducer transmitting said acoustic signal having said second signature into said acoustic data bus in response to said address encoded in said confirmation signal or in response to said signature signal having said second signature from said controller means when said first signature of said output signal from said input stimulus sensor is translated by said controller means into said signature signal having said second signature.

8. The multiple wellbore tool apparatus of claim 7, wherein said acoustic data bus is disposed within said wellbore fluid.

9. The multiple wellbore tool apparatus of claim 7, further comprising an outer housing, said acoustic data bus being disposed within said outer housing.

10. The multiple wellbore tool apparatus of claim 7, wherein said included wellbore tool comprises a valve.

11. The multiple wellbore tool apparatus of claim 7, wherein said included wellbore tool comprises a flowmeter.

12. The multiple wellbore tool apparatus of claim 7, wherein said included wellbore tool comprises a packer.

13. The multiple wellbore tool apparatus of claim 7, wherein said included wellbore tool comprises a pressure recorder.

14. The multiple wellbore tool apparatus of claim 7, wherein said included wellbore tool comprises a perforating gun.

15. The multiple wellbore tool apparatus of claim 7, wherein a second one of said plurality of wellbore tools comprises:

a second said input stimulus sensor;

a second said included wellbore tool adapted to be operated and adapted to generate a second confirmation signal having an address encoded therein indicative of at least an initiation of the operation of said second included wellbore tool;

a second said acoustic transducer adapted to receive acoustic signals from said acoustic data bus; and a second said controller means interconnected between the second input stimulus sensor, the second included wellbore tool, and the second acoustic transducer, said second acoustic transducer receiving said acoustic signal having said second signature from said acoustic dam bus and generating an output signal having said second signature, the second controller means attempting to translate said second signature of said output signal from said second acoustic transducer into a second instruction signal, said second included wellbore tool being operated in response to said second instruction signal when said second controller means translates said second signature of said output signal into said second instruction signal, said second included wellbore tool generating said second confirmation signal having said address encoded therein indicative of a completion of an operation of said second included wellbore tool when said operation of said second included wellbore tool is completed.

16. The multiple wellbore tool apparatus of claim 15, wherein said first included wellbore tool is selected from a first group consisting of: a valve, a flowmeter, a packer, a recorder, and a perforating gun.

17. The multiple wellbore tool apparatus of claim 16, wherein said second included wellbore tool is selected from a second group when said first included wellbore tool is said valve, said second group consisting of: said flowmeter, said packer, said recorder, and said perforating gun.

18. The multiple wellbore tool apparatus of claim 16, wherein said second included wellbore tool is selected from a second group when said first included wellbore tool is said flowmeter, said second group consisting of: said valve, said packer, said recorder, and said perforating gun.

19. The multiple wellbore tool apparatus of claim 16, wherein said second included wellbore tool is selected from a second group when said first included wellbore tool is said packer, said second group consisting of: said valve, said flowmeter, said recorder, and said perforating gun.

20. The multiple wellbore tool apparatus of claim 16, wherein said second included wellbore tool is selected from a second group when said first included wellbore tool is said recorder, said second group consisting of: said valve, said flowmeter, said packer, and said perforating gun.

21. The multiple wellbore tool apparatus of claim 16, wherein said second included wellbore tool is selected from a second group when said first included wellbore tool is said perforating gun, said second group consisting of: said valve, said flowmeter, said packer, and said recorder.

22. The multiple wellbore tool apparatus of claim 15, wherein said acoustic data bus is disposed within said wellbore fluid.

23. The multiple wellbore tool apparatus of claim 15, further comprising an outer housing enclosing said multiple wellbore tool apparatus, said acoustic data bus being disposed within said outer housing.

24. The multiple wellbore tool apparatus of claim 15, wherein:

said second controller means translates said address encoded in said second confirmation signal from said second included wellbore tool into a second signature signal having a fourth signature, and said second acoustic transducer transmits a second acoustic signal having said fourth signature into said acoustic data bus in response to said second signature signal having said fourth signature from said second controller means.

25. The multiple wellbore tool apparatus of claim 24, wherein a third one of said plurality of wellbore tools comprises:

a third said input stimulus sensor;

a third said included wellbore tool adapted to be operated and adapted to generate a third confirmation signal having an address encoded therein indicative of at least an initiation of the operation of said third included wellbore tool;

a third said acoustic transducer adapted to receive acoustic signals from said acoustic data bus; and a third said controller means interconnected between the third input stimulus sensor, the third included wellbore tool, and the third acoustic transducer, said third acoustic transducer receiving said second acoustic signal having said fourth signature from said acoustic data bus and generating an electrical output signal having said fourth signature, the third controller means attempting to translate said fourth signature of said electrical output signal from said third acoustic transducer into a third instruction signal, said third included wellbore tool being operated in response to said third instruction signal when said third controller means translates said fourth signature of said output signal into said third instruction signal, said third included wellbore tool generating said third confirmation signal having said address encoded therein indicative of a completion of an operation of said third included wellbore tool when said operation of said third included wellbore tool is completed.

26. The multiple wellbore tool apparatus of claim 25, wherein said acoustic data bus is disposed within said wellbore fluid.

27. The multiple wellbore tool apparatus of claim 25, further comprising an outer housing, said acoustic data bus being disposed within said outer housing.

28. A method of operating a multiple wellbore tool apparatus adapted to be disposed in a fluid filled wellbore including a plurality of wellbore tools where each of said plurality of wellbore tools includes a sensor adapted for sensing a stimulus having a first signature propagating in the wellbore fluid, an included tool adapted to operate and adapted to generate a confirmation signal having an address encoded therein indicative of at least an initiation of the operation of said included tool, an acoustic transducer adapted to transmit an acoustic signal having a signature into an acoustic signal data bus and to receive an acoustic signal having a signature from said acoustic signal data bus, and a controller adapted for storing information interconnected between said sensor, said included tool, and said acoustic transducer, comprising the steps of:

(a) propagating said stimulus having said first signature in the wellbore fluid;

(b) sensing, by said sensor of each of said plurality of wellbore tools, said stimulus having said first signature;

(c) comparing, by said controller of each of said plurality of wellbore tools, said first signature of said stimulus received in said sensor with said information stored in each said controller;

(d) generating, by a controller of a first one of said plurality of wellbore tools, an output signal when said first signature of said stimulus propagating in the wellbore fluid corresponds to said information stored in said controller of said first one of said plurality of wellbore tools, said output signal being either an instruction signal or a signature signal having a second signature;

(e) operating said included tool of said first one of said plurality of wellbore tools when said output signal from said controller of said first one of the plurality of wellbore tools is said instruction signal, said included tool of said first one of said plurality of wellbore tools generating said confirmation signal having said address encoded therein indicative of at least said initiation of said operation of said included tool of said first one of said plurality of wellbore tools; and (f) transmitting, by said acoustic transducer of said first one of said plurality of wellbore tools, an acoustic signal having said second signature into said acoustic signal data bus either when said output signal from said controller of said first one of said plurality of wellbore tools is said signature signal having said second signature or in response to said address encoded in said confirmation signal.

29. The method of claim 28, wherein said acoustic signal data bus is disposed within said wellbore fluid, and wherein the transmitting step (f) comprises the step of:

transmitting said acoustic signal into said wellbore fluid.

30. The method of claim 28, wherein said wellbore apparatus includes an outer housing, said acoustic signal data bus being disposed within said outer housing, the transmitting step (f) comprises the step of:

transmitting said acoustic signal into said outer housing.

31. The method of claim 28, further comprising the steps of:

(g) receiving, by said acoustic transducer of the remaining ones of said plurality of wellbore tools, said acoustic signal having said second signature from said acoustic signal dam bus, and generating, by an acoustic transducer of a second one of said plurality of wellbore tools, an electrical output signal having said second signature in response thereto, a controller of said second one of said plurality of wellbore tools having information stored therein;

(h) comparing, by said controller of said second one of said plurality of wellbore tools, said second signature of said electrical output signal with said information stored therein and generating an instruction signal when said second signature of said electrical output signal corresponds to said information stored in said controller of said second one of said plurality of wellbore tools; and (i) operating said included tool of said second one of said plurality of wellbore tools in response to said instruction signal, said included tool of said second one of said plurality of wellbore tools generating a second confirmation signal having an address encoded therein indicative of at least an initiation of the operation of said included tool of said second one of said plurality of wellbore tools.

32. The method of claim 31, further comprising the steps of:

(j) comparing, by said controller of said second one of said plurality of wellbore tools, said address encoded in said second confirmation signal from said included tool with said information stored in said controller of said second one of said plurality of wellbore tools and generating a second signature signal having a fourth signature when said address in said second confirmation signal corresponds to said information stored in said controller of said second one of said plurality of wellbore tools; and (k) transmitting, by said acoustic transducer of said second one of said plurality of wellbore tools, a second acoustic signal having said fourth signature onto said acoustic signal data bus in response to said second signature signal having said fourth signature generated from said controller of said second one of said plurality of wellbore tools.

33. The method of claim 32, further comprising the steps of:

(l) receiving, by said acoustic transducers of the remaining ones of said plurality of wellbore tools, said second acoustic signal having said fourth signature from said acoustic signal data bus, and generating, by an acoustic transducer of a third one of said plurality of wellbore tools, an electrical output signal having said fourth signature in response thereto, a controller of said third one of said plurality of wellbore tools having information stored therein;

(m) comparing, by said controller of said third one of said plurality of wellbore tools, said fourth signature of said electrical output signal with said information stored therein and generating an instruction signal when said fourth signature of said electrical output signal corresponds to said information stored in said controller of said third one of said plurality of wellbore tools; and (n) operating said included tool of said third one of said plurality of wellbore tools in response to said instruction signal, said included tool of said third one of said plurality of wellbore tools generating a third confirmation signal having an address encoded therein indicative of at least an initiation of the operation of said included tool of said third one of plurality of wellbore tools.

34. A system for operating a multiple wellbore tool apparatus adapted to be disposed in a wellbore, comprising:

a first wellbore tool adapted to be operated;

a second wellbore tool connected to said first wellbore tool adapted to be operated;

acoustic receiver means for receiving an acoustic command signal in the wellbore; and control means, connected to said acoustic receiver means, said first wellbore tool, and said second wellbore tool and responsive to said acoustic receiver means in said wellbore, for generating control signals for said first wellbore tool and said second wellbore tool, a first one of said control signals operating said first wellbore tool, said first wellbore tool generating a first confirmation signal having an address encoded therein indicative of at least an initiation of the operation of said first wellbore tool, a second one of said control signals operating said second wellbore tool in response to the address encoded in said first confirmation signal, said second wellbore tool generating a second confirmation signal having an address encoded therein indicative of at least an initiation of the operation of said second wellbore tool.

35. A remotely controlled multiple wellbore tool apparatus adapted to be disposed in a wellbore, comprising:

a plurality of wellbore tools, each of said plurality of wellbore tools including: a respective acoustic receiver responsive to a respective predetermined acoustic control signal, a respective controller responsive to said respective acoustic receiver, and a respective included wellbore tool responsive to said respective controller, at least one of said plurality of wellbore tools further including an acoustic transmitter responsive to said controller of the respective said wellbore tool; and wherein said controller of said at least one said wellbore tool includes means for actuating said included wellbore tool, said included wellbore tool generating a confirmation signal having an address encoded therein indicative of the actuation of said included wellbore tool, and means responsive to the address encoded in said confirmation signal for actuating said acoustic transmitter to transmit the respective predetermined acoustic control signal to said acoustic receiver of another said wellbore tool.

36. A system for performing operations in a wellbore, comprising:

a first apparatus including a first acoustic receiver, a first controller responsive to said first acoustic receiver, a first included wellbore tool responsive to said first controller, and a first acoustic transmitter responsive to said first controller;

a second apparatus including a second acoustic receiver and a second controller responsive to said second acoustic receiver; and master acoustic transmitter means for transmitting a first control signal to which said first acoustic receiver is responsive so that said first acoustic receiver actuates said first controller to operate said first included wellbore tool, the first included wellbore tool generating a confirmation signal having an address encoded therein indicative of at least an initiation of the operation of said first included wellbore tool, to further operate said first acoustic transmitter in response to the address encoded in said confirmation signal to transmit a second control signal from said first acoustic transmitter to which said second acoustic receiver is responsive to thereby operate said second controller.

37. The wellbore tool of claim 1, further comprising:

a first housing including said sensor means, said transducer means, and said controller means; and a second housing detachably connected to said first housing, said second housing including said included wellbore tool.

38. The method of claim 4, wherein said wellbore tool includes a first housing enclosing said sensor and said transducer and said controller, and a second housing detachably connected to said first housing where said second housing encloses said included wellbore tool.

39. The multiple wellbore tool apparatus of claim 7, wherein said first one of said plurality of wellbore tools includes a first housing enclosing said input stimulus sensor and said acoustic transducer and said controller means, and a second housing detachably connected to said first housing and enclosing said included wellbore tool.

40. The multiple wellbore tool apparatus of claim 15, wherein:

said first one of said plurality of wellbore tools comprises a first housing enclosing said input stimulus sensor and said acoustic transducer and said controller means, and a second housing detachably connected to said first housing and enclosing said included wellbore tool, and said second one of said plurality of wellbore tools includes another said first housing and a third housing detachably connected to said another said first housing and enclosing said second said included wellbore tool.

41. The multiple wellbore tool apparatus of claim 25, wherein:

said first one of said plurality of wellbore tools comprises a first housing enclosing said input stimulus sensor and said acoustic transducer and said controller means, and a second housing detachably connected to said first housing and enclosing said included wellbore tool, said second one of said plurality of wellbore tools includes another said first housing and a third housing detachably connected to said another said first housing and enclosing said second said included wellbore tool, and said third one of said plurality of wellbore tools includes still another said first housing and a fourth housing detachably connected to said still another said first housing and enclosing said third said included wellbore tool.

42. The method of claim 28, wherein said each of said plurality of wellbore tools comprises a first housing enclosing said sensor and said acoustic transducer and said controller, and a second housing detachably connected to said first housing and enclosing said included tool.

43. The system of claim 34, wherein said control means comprises first control means for generating said first one of said control signals for operating said first wellbore tool, and second control means for generating said second one of said control signals for operating said second wellbore tool, and wherein said system further comprises:

a first housing adapted for enclosing said acoustic receiver means and said first control means;

a second housing detachably connected to said first housing adapted for enclosing said first wellbore tool;

another said first housing adapted for enclosing said first control means, said first control means in said another said first housing being said second control means; and a third housing detachably connected to said another said first housing adapted for enclosing said second wellbore tool.

44. The remotely controlled multiple wellbore tool apparatus of claim 35, wherein said each of said plurality Of wellbore tools comprises:

a first housing adapted for enclosing said acoustic receiver and said acoustic transmitter and said controller; and a second housing detachably connected to said first housing adapted for enclosing said included wellbore tool.

45. The system of claim 36, further comprising:

a first housing adapted for enclosing said first acoustic receiver and said first controller and said first acoustic transmitter;

a second housing detachably connected to said first housing adapted for enclosing said first included wellbore tool; and another said first housing adapted for enclosing said second acoustic receiver and said second controller.

46. A system adapted to be disposed in a wellbore, comprising:

a first housing, a sensor disposed in said first housing adapted for receiving a stimulus having a first signature and generating an output signal having said first signature, and a controller disposed in said first housing and connected to the sensor adapted for storing information and generating either an instruction signal or a signature signal when said first signature of said output signal from said sensor corresponds to part of said information stored in said controller;

a second housing detachably connected to said first housing, a first included wellbore tool disposed in said second housing and detachably connected to said controller in said first housing, said first included wellbore tool being operated in response to said instruction signal from said controller, said first included wellbore tool generating a first confirmation signal when said first included wellbore tool is operated;

an acoustic receiver-transmitter disposed in said first housing and connected to said controller in said first housing adapted for transmitting an acoustic signal in response to either said signature signal from said controller in said first housing or said first confirmation signal from said first included wellbore tool in said second housing;

another said first housing including said acoustic receiver-transmitter adapted for receiving said acoustic signal and said controller: and a third housing detachably connected to said another said first housing, a second included wellbore tool disposed in said third housing and detachably connected to said controller disposed in said another said first housing, said acoustic receiver-transmitter in said another said first housing receiving said acoustic signal from said acoustic receiver-transmitter in said first housing and generating an output signal response thereto, said controller in said another said first housing receiving said output signal from said acoustic receiver-transmitter in said another said first housing and generating a second instruction signal in response thereto, said second included wellbore tool in said third housing being operated in response to said second instruction signal from said controller in said another said first housing and generating a second confirmation signal when said second included wellbore tool is operated, said first confirmation signal including a first address encoded therein, said second confirmation signal including a second address encoded therein.

* * * * *